US011994135B2

(12) United States Patent
Espie et al.

(10) Patent No.: US 11,994,135 B2
(45) Date of Patent: May 28, 2024

(54) METHOD AND APPARATUS FOR COMPRESSING A GAS FEED WITH A VARIABLE FLOW RATE

(71) Applicant: Air Products and Chemicals, Inc., Allentown, PA (US)

(72) Inventors: David M. Espie, Lansdale, PA (US); Gregory W. Henzler, Emmaus, PA (US); Zhong-Xiang (John) Zhu, London (CA); Graeme Richard Wilson, Surrey (GB)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 494 days.

(21) Appl. No.: 17/346,856

(22) Filed: Jun. 14, 2021

(65) Prior Publication Data

US 2022/0397119 A1 Dec. 15, 2022

(51) Int. Cl.
*F04D 17/12* (2006.01)
*C25B 1/04* (2021.01)
(Continued)

(52) U.S. Cl.
CPC ..... *F04D 17/12* (2013.01); *C25B 1/04* (2013.01); *C25B 15/081* (2021.01); *F04D 25/16* (2013.01); *F04D 27/02* (2013.01); *F04D 27/0207* (2013.01)

(58) Field of Classification Search
CPC ..... F04D 25/16; F04D 27/005; F04D 27/007; F04D 27/0215; F04D 27/0223; F04D 27/02; F04D 27/0284; F04D 17/12; F04D 17/14
See application file for complete search history.

(56) References Cited

U.S. PATENT DOCUMENTS 5,743,715 A * 4/1998 Staroselsky ..... F04D 27/0269 417/2
7,444,189 B1 10/2008 Marhoefer
(Continued)

FOREIGN PATENT DOCUMENTS

CN 108599245 A 9/2018
CN 211040479 U 7/2020
(Continued)

OTHER PUBLICATIONS

Witkowski, Andrzej et al; Comprehensive analysis of hydrogen compression and pipeline transportation from thermodynamics and safety aspects, Energy, Elsevier, Amsterdam, NL vol. 141, May 26, 2017, pp. 2508-2518.
(Continued)

*Primary Examiner* — Philip E Stimpert
(74) *Attorney, Agent, or Firm* — Matthew Richard Weaver

(57) ABSTRACT

Energy efficiency and/or operational stability of a multistage compression system comprising a plurality (N) of centrifugal compressors that is compressing a gas feed having a variable flow rate is improved by adjusting reversibly the load on each compressor in response to changes in the flow rate of the gas feed using a main recycle system to enable operation of the centrifugal compressors at turndown capacity during periods when the flow rate is below total turndown capacity for all of the compressors, and if necessary, using the local recycle systems in order to avoid activation of anti-surge control, and switching one or more centrifugal compressors into low power mode or shutdown mode as required.

19 Claims, 4 Drawing Sheets

(51) Int. Cl.

| | |
|---|---|
| ***C25B 15/08*** | (2006.01) |
| ***F04D 25/16*** | (2006.01) |
| ***F04D 27/02*** | (2006.01) |

(56) References Cited

U.S. PATENT DOCUMENTS

| | | | | |
|---|---|---|---|---|
| 2003/0063981 | A1* | 4/2003 | Saxena | F01D 17/06 417/286 |
| 2003/0175564 | A1 | 9/2003 | Mitlitsky et al. | |
| 2004/0255615 | A1 | 12/2004 | Hupkes et al. | |
| 2006/0225445 | A1* | 10/2006 | Lifson | F25B 1/10 62/175 |
| 2008/0005964 | A1 | 1/2008 | Hajiaghajani et al. | |
| 2013/0177393 | A1 | 7/2013 | Sishtla | |
| 2014/0079593 | A1 | 3/2014 | Naito et al. | |
| 2017/0122129 | A1 | 5/2017 | Heid et al. | |
| 2017/0145915 | A1 | 5/2017 | Heid et al. | |
| 2017/0317502 | A1 | 11/2017 | Ito | |

FOREIGN PATENT DOCUMENTS

| | | | |
|---|---|---|---|
| CN | 112086960 | A | 12/2020 |
| JP | 2018207728 | A | 12/2018 |
| RU | 2753754 | C1 | 8/2021 |
| WO | 2016170700 | A1 | 10/2016 |

OTHER PUBLICATIONS

"K-GreeN-Digital-Solutions", Kellogg, Brown & Root LLC; Jan. 2021, 17 pgs.

* cited by examiner

METHOD AND APPARATUS FOR COMPRESSING A GAS FEED WITH A VARIABLE FLOW RATE

TECHNICAL FIELD

The present invention is concerned with ways to improve energy efficiency and stability in a multistage compression system compressing a gas feed with a variable flow rate. The present invention is particularly concerned with ways to conserve electricity and prevent disturbances in the flow of net compressed gas from the system that would otherwise be due to activation of anti-surge controls.

BACKGROUND

Centrifugal compressors are a type of dynamic compressor, in which gas is compressed by mechanical action of rotating vanes or impellers which impart velocity to the gas. Gas typically enters at the center of the impellers and is propelled out to the radial edges under rotary motion to deliver gases at high velocity which impact the casing. The velocity of the gas is converted to a static pressure to deliver high pressure gases. These types of compressors are particularly suited to handling large volumes of gases at lower costs.

To properly compress process gases in a centrifugal compressor, dry gas seals (or "DGS") are typically used to minimize any gas leakage. These dry gas seals contain two opposed seal faces or rings which are separated during normal operation of the centrifugal compressor to compress gas.

Typically, gas for compression is produced entirely using electricity generated from a conventional energy source such as onsite petrol-, diesel- or hydrogen-powered generator(s), fuel cells, or taken from a local or national grid. In such instances, the centrifugal compressors are run at maximum capacity in order to produce the highest possible yield of net compressed product gas. The motors which drive the impellers of said centrifugal compressors are thus typically operated at a fixed speed (e.g. maximum). In these instances, the flow of the gas feed to the compression system is always maintained at a substantially constant, maximum flow to maximise the output of net compressed gas.

U.S. Pat. No. 5,743,715A relates to a process for balancing load between compressors to ensure that the surge control lines of all compressors in a system are reached simultaneously. This document does not relate to how to compress gas having a variable flow rate, such as due to gas being produced using a renewable energy source.

The present inventors are not currently aware of any prior art which addresses the issues associated with the compression of a gas feed which has a variable flow rate across a wide range of flow.

In particular, the invention is concerned with compressing a gas feed where the flow may vary over a large range (e.g. 0 to 100% flow) in relatively short timescales (e.g. 1 day), such as for example gas produced using electricity generated at least in part by one or more renewable energy sources (e.g solar and/or wind).

DETAILED DESCRIPTION

According to a first aspect of the present invention, there is provided a process for operating a multistage compression system compressing a gas feed having a variable flow rate, said multistage compression system comprising a feed end, a plurality (N) of centrifugal compressors in parallel, a product end, and a main recycle system for recycling gas through the plurality (N) of centrifugal compressors, wherein each centrifugal compressor comprises an inlet, an outlet, and a local recycle system with anti-surge control for recycling gas from the outlet to the inlet, said process comprising:

(a) during periods when the gas feed is received by the multistage compression system at a flow equal to the total maximum capacity of a first number (n) of centrifugal compressors producing net compressed gas, operating said first number (n) of centrifugal compressors at full load for compressing the gas feed;

(b) during periods when the gas feed is received by the multistage compression system at a flow in a range from less than total maximum capacity of said first number (n) of centrifugal compressors to total turndown capacity of said first number (n) of centrifugal compressors, operating said first number (n) of centrifugal compressors at minimum load for compressing the gas feed, said minimum load being determined based on the flow of the gas feed;

(c) during periods when the gas feed is received by the multistage compression system at a flow in a range from less than total turndown capacity of the first number (n) of centrifugal compressors to more than total maximum capacity for a second number (n−1) of centrifugal compressors producing net compressed gas, recycling compressed gas using the main recycle system as required to maintain the load of said first number (n) of centrifugal compressors above the point at which anti-surge controls are activated; and (d) during periods when the gas feed is received by the multistage compression system at a flow equal to the total maximum capacity for said second number (n−1) of centrifugal compressors, unloading a centrifugal compressor to put said compressor into a low power mode or shutdown mode in which said compressor produces no net compressed gas, while simultaneously loading the remaining centrifugal compressors to maximum capacity, wherein the process is reversible at any point, and wherein n is a whole number equal to or less than N.

In the following discussion of embodiments of the present invention, the pressures given are absolute pressures unless otherwise stated.

The invention has particular application to processes in which the variable flow of gas being fed to the multistage compression system is a result of the gas being produced using electricity generated at least in part from at least one renewable energy source. Preferably, such a gas may be hydrogen gas produced by the electrolysis of water.

A drawback of the use of renewable energy to produce gas for compression in the centrifugal compressor(s) is the inherent variation in the availability of the energy source, which may span from full power to no power over the course of a single day. Although other energy sources (e.g. battery power, or non-renewable energy sources) may be used to supplement the power when availability is low, it is likely that there may still not be enough to produce the maximum flow of gas for compression required to fully operate the or each centrifugal compressor.

The flow of gas for compression may vary widely from maximum flow to a very low flow, or none at all, across a single day, for example. The centrifugal compressor(s) can tolerate some variation in the flow of gas for compression but not to the extent that would be required without turning them all off periodically.

Centrifugal compressors are typically fitted with a local recycle system having anti-surge controls (e.g. anti-surge valve controlled by a control system). This local recycle system protects the centrifugal compressor from risk of operational damage caused by compressor surge. Surge occurs where the flow of the gas feed is reduced beyond a point at which the compressor can maintain operation at a stable impeller speed. Surge may result in reverse flow of hot gas through the compressor and/or severe pressure pulsations throughout the machine, possibly leading to severe mechanical vibration and damage. Typically, anti-surge controls are designed to activate just before the compressor reaches the surge point. When activated, these controls rapidly recycle gas through the centrifugal compressor, e.g. by opening the local recycle valve, to increase the compressor load and prevent surge. However, this is often at the expense of the stability and controllability of the overall process and/or plant.

The anti-surge controls of the local recycle system may be activated at a flow of about 20%, preferably about 10% above the flow at which the centrifugal compressor surges (sometimes referred to as the "surge line" in the art). Where the flow of the gas feed to the compression system drops below this anti-surge control activation point, the compressor anti-surge controls act to protect the compressor. This protective action causes severe process upsets to adjacent equipment and can lead to an overall trip of the facility in the most extreme cases.

Moreover, activation of anti-surge controls disrupts the flow of net compressed gas by introducing large amounts of recycled gas to the system in a short space of time. This is undesirable since it may interrupt stable flow of net compressed gas at the outlet of the system. The expression "net compressed hydrogen gas" means the total amount of compressed gas being produced minus the total amount of gas that is recycled.

When a centrifugal compressor is turned off or shut down, the rotor, or impeller, speed reduces until the opposed seal faces of the dry gas seals (DGS) are no longer separated and come into contact with each other. Thus, turning the centrifugal compressor(s) off and on frequently will accelerate wear of the DGS. This decreases the lifetime of the centrifugal compressor(s), thus requiring replacement or repair more often which can increase costs. Wear of the DGS also occurs upon restarting or powering on the centrifugal compressors.

A centrifugal compressor is exposed to risk of damage each time it is started up or shut down. Indeed, there is a higher chance of having compressor issues during start-up than shut-down. In this regard, there are typically critical speeds that should be avoided. In addition, if compressors are shut down for an extended period of time, they can be more susceptible to pitting corrosion and other types of corrosion which can lead to stress corrosion cracking and eventually failure of an impellor/compressor.

The above issues do not apply to centrifugal compressors that compress gas which has a gas flow rate that is substantially constant and unchanging, and guaranteed to be maintained substantially above the maximum turndown capacity or anti-surge control point of the centrifugal compressors. For example, these issues are not associated with gas produced entirely using energy from non-renewable electrical power grids since the flow of the gas feed is at substantially maximum constant flow so that the compressors are seldom turned off.

The present inventors have therefore identified that there is a desire in the art to provide an improved way of operating centrifugal compressor(s) that are capable of compressing a gas feed with a variable flow rate over a wide range, such as gas produced using electricity generated at least in part by renewable energy source(s).

The present inventors have devised a process as described herein for operating a multistage compression system that reduces the number of shutdowns of the centrifugal compressor(s), and thus increases the lifetime of the dry gas seal(s) and the reliability of the centrifugal compressor(s). Alternatively or in addition, the inventors have devised a process by which electricity can be conserved, for example so that it can be used in other parts of the process such as for producing feed gas and/or as part of a downstream process for consuming compressed gas. Alternatively, or in addition the present invention may allow for compression of a gas feed with a variable flow rate over a wide range, without requiring unnecessary shut downs of compressors and/or excessively recycling of compressed gas and/or use of excessive amounts of electricity and/or a disturbance in the flow of net compressed gas as a result of anti-surge control activation.

The multistage compression system is for compressing a gas feed having a variable flow rate, preferably in preparation for consumption in at least one downstream process.

The gas for compression is typically produced using electricity generated at least in part by at least one renewable energy source, and may be any suitable gas. However, the process has particular application where the gas for compression is hydrogen gas, e.g. hydrogen gas produced by the electrolysis of water. This may be carried out by a plurality of electrolysers.

In some embodiments the process comprises producing hydrogen gas by electrolysis of water. Additionally or alternatively, the process may comprise feeding compressed hydrogen gas to at least one downstream process for consumption in said downstream process(es).

Thus, in some preferred embodiments the process comprises:

- producing hydrogen gas by electrolysis of water;
- compressing said hydrogen gas in the multistage compression system operated according to the present invention to produce compressed hydrogen gas; and
- feeding said compressed hydrogen gas to at least one downstream process for consumption in said downstream process(es).

In some embodiments, at least some of the compressed hydrogen gas is used to produce ammonia and/or methanol in the downstream process(es), preferably to produce ammonia.

Centrifugal compression is particularly suited to compressing large volumes of hydrogen gas at a lower cost, and thus the compression of hydrogen gas is particularly preferred and advantageous to the process of the invention. Moreover, hydrogen gas produced by electrolysis is even further suited to centrifugal compression due to being "wet" and having a higher density, making centrifugal compression of said gas more efficient than compressing hydrogen gas which has not been produced by electrolysis.

Operation of Centrifugal Compressors in a Multistage Compression System

The present invention concerns a multistage compression system comprising a feed end, a plurality (N) of centrifugal compressors in parallel, a product end, and a main recycle system for recycling gas through the plurality (N) of centrifugal compressors (or though the number of centrifugal compressors producing net compressed gas if one or more of the plurality (N) of centrifugal compressors is in low power mode or shutdown mode).

The main recycle system is for recycling gas through the plurality of (N) centrifugal compressors. The main recycle system therefore recycles gas for all of the centrifugal compressors simultaneously, rather than individually. The main recycle system may therefore receive gas discharged from the product ends of the centrifugal compressors and, after suitable pressure reduction, feed this reduced pressure gas to the feed ends of the centrifugal compressors. The main recycle system may receive compressed gas from each of the centrifugal compressors before or after it is mixed into a single header line. After suitable pressure reduction, the reduced pressure gas may be split from a header and fed to each of the centrifugal compressors. This allows all N compressors to operate with the same performance curve, greatly simplifying the load sharing between the machines. The main recycle system typically operates alongside speed control of the compressors to modulate and maintain a constant suction pressure.

The use of a main recycle system in the context of compression of wet hydrogen gas produced by electrolysis is particularly advantageous. Hydrogen gas produced by electrolysis of water is typically saturated with water, and during compression the water content of the hydrogen gas may change, e.g. due to cooling steps in the process. As the water content changes, so does the apparent molecular weight of the hydrogen gas—this in turn may change the discharge pressure ratio at the product end of an individual compressor. Therefore, the use of a main recycle system additionally allows for the apparent molecular weight of wet hydrogen gas across of all the plurality (N) compressors to be kept substantially constant.

N is a whole number denoting the total number of centrifugal compressors arranged in parallel in the multistage compression system with which the process of the invention is to be carried out, and this number may dependent on the process requirements (e.g. the scale of the process, the downstream process(es), etc.).

Each centrifugal compressor comprises an inlet, an outlet, and a local recycle system with anti-surge control. The local recycle system is for recycling gas from the outlet to the inlet of the centrifugal compressor(s) with which it is associated. Local recycle systems are already known in the art and are primarily used for preventing the compressor surge or during unloading of compressors. When in use, the local recycle system receives gas from the outlet of the centrifugal compressor and, after suitable pressure reduction, feeds reduced pressure gas to the inlet of the centrifugal compressor. In some embodiments herein, the recycle system may be associated with more than centrifugal compressor, such as more than one centrifugal compressor arranged in series, such as across multiple stages of compression.

The pressure of gas being recycled may be reduced to an appropriate extent using a pressure reduction means such as a valve. In this regard, an appropriate extent would be to the inlet pressure of the compressor to which the gas is fed.

In some embodiments herein, the multistage compression system comprises centrifugal compressors arranged in series as part of multiple stages of compression, and a local recycle system recycles gas from the outlet of an intermediate or final stage to the inlet of the initial stage. That is, when in use, the local recycle system received gas from the outlet of a downstream stage of compression and, after suitable pressure reduction, feeds reduced pressure gas to the inlet of an upstream stage of compression.

This allows for the number of local recycle systems, and associated valves, to be reduced, thereby simplifying the design and operation of the compression system and reducing costs. However, in such embodiments, it will be appreciated that no gas can be fed from a gas storage system to a point between the downstream and upstream stage.

As explained above, the local recycle system is rapidly activated when the flow to the compressor reaches an anti-surge control point, e.g. about 10% flow above the surge line.

In the process of the present invention, the multistage compression system is operated such that it responds to changes in the flow of the gas feed at the inlet to the multistage compression system. The flow of this gas feed is variable, and certain modes of operation of the centrifugal compressors as described herein will be activated in response to certain changes in this gas feed flow. Operational changes occur within the system to accommodate the change in the flow of the gas feed.

The present invention generally lies in a number of actions being carried out in response to said changes in the flow of the gas feed, said actions being fully reversible at any point in the process depending on the changes in the flow of the gas feed, such as when the change in flow of the gas feed is reversed.

During Periods Specified in (a)—Maximum Flow

During periods when the gas feed is received by the multistage compression system at a flow equal to the total maximum capacity of a first number (n) of centrifugal compressors producing net compressed gas, the process comprises operating said first number (n) of centrifugal compressors at full load for compressing the gas feed.

The first number (n) is the number of centrifugal compressors in the multistage compression system which are operating to produce net compressed gas, i.e. not shutdown, off or in low power mode. Thus, in the context of the present invention, (n) is a whole number (1, 2, 3, . . . etc.) equal to or less than (N), the total number of centrifugal compressors for carrying out the process. In the context of the invention, the first number (n) cannot be equal to zero, but it still may be desired, in some instances, to turn off all of the centrifugal compressors or put them in idling mode (see below).

In other words, when the flow of the gas feed matches the total maximum capacity of the first number (n) of centrifugal compressors, these compressors are operated at maximum capacity to produce as much net compressed gas as possible.

The term "total" is used herein to mean the sum of the maximum capacities of said (n) centrifugal compressors. The term "maximum capacity" refers to 100% capacity of a compressor, i.e. there is a maximum amount of the gas feed flow being compressed by the compressor at 100% of its maximum power and rotor speed (i.e. full load). The "load" of a centrifugal compressor refers to the total flow of compressed gas being produced (including any gas flow that is being recycled by the main recycle system). The load of a centrifugal compressor may be controlled by changing the rotor speed using suitable VFDs, or adjusting the inlet guide vanes, for example.

During Periods Specified in (b)—Reduced Flow (Turndown)

During periods when the gas feed is received by the multistage compression system at a flow in a range from less than total maximum capacity of said first number (n) of centrifugal compressors to total turndown capacity of said first number (n) of centrifugal compressors, the process comprises operating said first number (n) of centrifugal compressors at minimum load for compressing the gas feed, said minimum load being determined based on the flow of the gas feed.

Besides operating the centrifugal compressors at maximum capacity, the flow of gas passing through centrifugal compressors can be varied in a few ways. This can be done by a change in power and rotor speed of the impellers, or by adjusting the inlet guide vanes, for example. However, flow through a centrifugal compressor can only be reduced to a certain extent before the anti-surge controls are activated. This process is known in the art as compressor "turndown". The capacity (or flow) at which a centrifugal compressor is turned down as far as possible, i.e. compressing a minimum flow of gas without activating any anti-surge controls, is known as its turndown capacity (or maximum turndown). This point is typically substantially at or just above the anti-surge control point.

The turndown capacity of each centrifugal compressor is thus defined herein as the minimum flow of gas that can be compressed by the centrifugal compressor without activation of its anti-surge control.

In turndown, the compressor power is less than 100% but at the same time about 60% or more, preferably about 70% or more, e.g. from 70% to 80%, relative to maximum power (100%). This reduction in compressor power leads to a reduction in rotor speed and thus there is an associated reduced flow of net compressed gas at the product end of the compressor. For a reduction in gas flow (at constant discharge pressure) to the multistage compression system, this will typically require a proportional reduction in compressor power.

The term "total turndown capacity" is used herein to refer to the sum of the turndown capacities of the first number (n) of centrifugal compressors, i.e. the capacity for compressing a flow of gas in the state where all of the centrifugal compressors are turned down as far as possible (at maximum turndown).

The minimum load is based on the flow of the gas feed, and so the minimum load refers to the minimum power and/or rotor speed of the compressor(s) which is suitable for compressing all of the flow of the gas feed to produce the required discharge pressure. For example, if the flow of the gas feed is at 85% of full flow, the total minimum load across the centrifugal compressors will be 85% of the full flow during these periods.

Preferably during these periods, the first number (n) of centrifugal compressors share the load substantially equally such that the load across all compressors is the same, i.e. the load is balanced across all of the centrifugal compressors such that the distance from the surge line is substantially equal for all compressors. In practice, there may be small inherent fluctuations in the load between compressors, but in this context the load across all of the operating compressors will be as close to equal as made possible by the apparatus.

During Periods Specified in (c)—Further Reduced Flow (Recycling)

During periods when the gas feed is received by the multistage compression system at a flow in a range from less than total turndown capacity of the first number (n) of centrifugal compressors to more than total maximum capacity for a second number (n−1) of centrifugal compressors producing net compressed gas, the process comprises recycling compressed gas using the main recycle system as required to maintain the load of said first number (n) of centrifugal compressors above the point at which anti-surge controls are activated.

Thus, in other words, the main recycle system recycles gas through the system as the flow rate of the gas feed drops further (compared with periods specified in (b)) below the point at which the anti-surge controls within the centrifugal compressors would otherwise be activated. This has the effect of maintaining the load of first number (n) above the anti-surge control point of the centrifugal compressors even though the flow of the gas feed drops further. Typically, the (n) centrifugal compressors are always operating in maximum turndown before any recycling is used to preserve as much electricity as possible, as far as safety concerns allow.

This allows for the multistage compression system to operate in a way whereby compressor anti-surge controls are not activated. As mentioned above, the activation of anti-surge controls disrupts the flow of net compressed gas at the output of the compression system, which in turn may be detrimental to other processes (e.g. a downstream process receiving compressed gas for consumption). The present invention therefore allows for a more stable output flow of compressed gas, and/or more reliable compressor operation by preventing damage to the compressors.

The operation of the first number of (n) centrifugal compressors as described above is only carried out until the flow of the gas feed to the multistage compression system reaches a point where the flow rate matches the maximum capacity for (n−1) centrifugal compressors (i.e. one compressor less than those in currently operation producing net compressed gas).

During Periods Specified in (d)—Optimising for (n−1) Compressors

As the gas feed drops further, the amount of recycling required by the main recycle system increases (to maintain the load of the first number (n) of centrifugal compressors above the point at which anti-surge controls are activated).

Compression of recycled gas wastes electricity, and therefore it is usually desirable to minimize the amount of gas which is being recycled by the main recycle system as much as possible. Thus, it is preferred that during periods specified in (c) the amount of recycling of compressed gas is maintained at a minimum amount to conserve electricity. In practice, safety concerns and operational risk may require that slightly more recycling is used where needed, above the minimum possible amount.

Thus, the present inventors have realized that, in a multistage compression system comprising a plurality of centrifugal compressors, it is possible to optimize the loads of the centrifugal compressors and minimize the amount of recycling. This can be done by dynamically and/or sequentially shutting compressors down or putting them in a low power mode (sometimes referred to herein as "idling") whilst simultaneously using the remaining compressors at a higher load with less (or no) recycling from the main recycle system.

During periods when the gas feed is received by the multistage compression system at a flow equal to the total maximum capacity for said second number (n−1) of centrifugal compressors, the process comprises unloading a centrifugal compressor to put said compressor into a low power mode or shutdown mode in which said compressor produces no net compressed gas, while simultaneously loading the remaining centrifugal compressors to maximum capacity.

This therefore allows for the gas feed to be compressed using fewer centrifugal compressors with little to no recycling of gas by the main recycle system, thus conserving electricity and operating the system in a more efficient manner.

Although it would in theory be possible to immediately reduce the recycling by the main recycle system to zero with the remaining compressors, in practice the change would ideally be more gradual. For example, as the centrifugal compressor is unloaded and the load of the remaining compressors raised to maximum capacity the main recycle system may gradually reduce the flow of recycled gas through the system to ensure a smoother transition during re-balancing of the loads between the centrifugal compressors. This would also assist in maintaining a stable output of net compressed gas from the system and more safely prevent inadvertent activation of any anti-surge controls.

This invention therefore may allow for the most efficient use of available electricity since putting some centrifugal compressors in low power mode or shutting down "frees up" available electricity which can then be supplied to other parts of the process, such as producing gas (e.g. electrolysers for producing hydrogen gas), compressing gas (e.g. supplying electricity for operating centrifugal compressors), or energy for downstream process(es), for example. This invention is therefore particularly useful in the context of renewable energy sources, where preservation of available energy is important.

The term "unloading" when used in the context of the present invention preferably comprises first reducing the flow of net compressed gas through said centrifugal compressor to zero using the local recycle system, and second reducing the load of said centrifugal compressor. That is, the flow of net compressed gas may be reduced by increasing the amount of gas being recycled through said centrifugal compressor by the local recycle system until all of the fresh gas entering the inlet is replaced with recycled gas. This advantageously allows the flow of net compressed gas through the system to be substantially unaffected by the process of lowering the load of the centrifugal compressor to put it in low power mode (idling) or shut down mode, and thus contributes to stable operation of net compressed gas through the system.

The centrifugal compressor may be unloaded either into a shutdown state, by turning it off or, alternatively, by putting it into a low power mode (see below).

Putting compressors in low power mode is preferred over fully shutting down, since this reduces the number of shut downs and/or restarts, and so prevents excessive wear of the dry gas seals (DGS) incorporated within the centrifugal compressors. Alternatively or in addition, this also allows the process to react more quickly to a reversal in the flow of the gas feed, since the time it takes to bring a compressor out of low power mode is less than it would be to power on from a complete shut down.

It will also be appreciated that the process can also be carried out repeatedly in a loop. That is, following the periods specified in (d), once a compressor has been shut down, the first number (n) of compressors producing net compressed gas will be reduced by 1. In this way, the conditions for the periods specified in (d) will switch with those specified in (a) and then the process may repeat, e.g. if the flow of the gas feed drops further, then the periods specified under (b), and then (c) and then (d) again may apply for the new value of the first number (n). That is, due to the change in the first number (n) of centrifugal compressors, the total maximum capacity, total turndown capacity, and total sum of the flow at which anti-surge control points activate will all change.

The process of the present invention is also reversible at any point. If the process is reversed, the logic of the steps will simply be reversed also. For example, when the process is being carried out in reverse, the process comprises (d) during periods when the gas feed is received by the multistage compression system at a flow greater than the total maximum capacity for said second number (n) of centrifugal compressors, loading a centrifugal compressor to bring said compressor out of a low power mode or shutdown mode, while simultaneously reducing the load of the remaining centrifugal compressors to total turndown capacity (when navigating from the periods specified in (d) to those in (c)). FIG. 4 is an illustrative example showing the thresholds and conditions at which certain actions in the process may be carried out and the resulting load, recycle flow, etc.

Thus, in addition the process may further comprise, (e) during periods when the gas feed is received by the multistage compression system at a flow greater than the total maximum capacity for said first number (n) of centrifugal compressors, re-loading an additional centrifugal compressor, if available, to bring said additional compressor out of a low power mode or shutdown mode until it begins producing net compressed gas.

This allows for the process to respond dynamically to the changes in the flow of gas in the gas feed to the multistage compression system, e.g. as a result of changes in the amount of gas produced by a process powered by a renewable energy source. In this way, the process of the present invention provides a method of operating a multistage compression to compress gas with a variable flow rate that, among other things, minimizes the electricity consumption, provides a stable output of net compressed gas from the system, and/or improves compressor reliability.

Where the first number (n) is equal to one, i.e. there is only one centrifugal compressor operating to produce net compressed gas, the process may additionally comprise, either using the main recycle system to continue to operate the final centrifugal compressor with a load above its anti-surge control point or, alternatively, turning off or putting the compressor in low power mode. Whether the final centrifugal compressor continues to operate may depend on whether there is sufficient electricity available to operate it, for example. In some instances it may be desired to keep at least one centrifugal compressor operating (n equal to 1) to compress at least some gas. It will be appreciated that where the first number (n) is equal to 1, the periods specified in (c) may apply until the flow of the gas feed increases to reach the conditions for the periods specified in (b).

Thus, the process may comprise, where the first number (n) is equal to one, during periods when the gas feed is received by the multistage compression system at a flow in a range from 0% flow to the maximum capacity of the centrifugal compressor producing net compressed gas, recycling compressed gas using the main recycle system as required to maintain the load of said centrifugal compressor above the point at which anti-surge controls are activated.

In some instances all of the centrifugal compressors may be turned off or put into low power mode, e.g. due to a very low flow in the gas feed. In these instances, it will be appreciated that the periods specified in (a) to (d) will no longer apply until such time as a centrifugal compressor is turned on or brought out of low power mode and is producing net compressed gas again.

If all of the centrifugal compressors are off, the user (or controller) of the system can determine at which point the flow of the gas feed is sufficient to justify turning a centrifugal compressor back on or bringing it out of low power mode. This may depend on available electricity for compression, for example, and may only be considered energy efficient if the flow of the gas feed allows for one centrifugal compressor to operate in maximum turndown without much recycling.

Thus, in some embodiments the process comprises, where all centrifugal compressors are not producing net compressed gas, during periods where the flow of the gas feed is equal to or greater than the total turndown capacity of at least one centrifugal compressor, re-loading a centrifugal compressor to bring said additional compressor out of a low power mode or shutdown mode until it begins producing net compressed gas.

Low Power Mode/Idling

Based on the current state of the art, the centrifugal compressor(s) would typically be shut down or turned off in response to a significant reduction in gas flow to the compression system, with a view to being restarted once gas flow increases sufficiently. However, in the context of the present invention the centrifugal compressors may instead be operated in a "low power" mode (LP mode).

Each centrifugal compressor typically has incorporated within it at least one dry gas seal with opposed seal faces. Any dry gas seal(s) suitable for centrifugal compressors may be used and these are known in the art, including but not limited to single seals, tandem seals and double opposed seals. To properly compress process gases in a centrifugal compressor, DGS may be used to minimize any gas leakage. These dry gas seals contain two opposed seal faces or rings, one is typically a rotating surface (sometimes called a "rotor") and the other is a stationary surface (sometimes called a "stator"). The rotating surface has a lifting geometry designed into it such that when it reaches a certain speed it lifts off the stationary surface creating a minute gap whereby the surfaces are non-contacting, that serves to minimize the gas leakage.

Centrifugal compressors powered by a standard non-renewable electrical power grid will be operated at a fixed speed (typically maximum speed to provide maximum amount of product gas). In these instances, the opposed seal faces of the dry gas seals are quickly separated and maintained as the motor speed of the compressor is maintained during compression of the gas. The centrifugal compressors are seldom shut down, turned off or restarted due to a constant availability of electricity from the electrical power grid.

When a centrifugal compressor with a dry gas seal is turned off, the motor speed reduces to zero and the opposed seal faces then come into contact. The more often this happens the more the opposed seal faces of the dry gas seals are worn down over time. This reduces the lifetime of the dry gas seals, which then means that compressors need to be repaired more often, increasing overall costs. More repairs of the compressors in the system also results in interruptions of the overall process to carry out said repairs, thus further complicating operation of the process and increasing costs.

DGS are often used when compressing high pressure, low molecular weight, flammable, toxic and/or expensive gases. As the DGS ages, there is typically more leakage across the seal leading to more losses which will have also an economic impact.

In said low power mode, the or at least one centrifugal compressor is operating with a low amount of power that is sufficient to prevent contact of said opposed seal faces of said dry gas seal in said centrifugal compressor(s) and is preferably producing no net compressed gas. Thus, the rotor speed of the centrifugal compressor is reduced but not completely zero (i.e. the compressor is not turned off or shutdown).

The opposed seal faces (sometimes called "rings" in the art) are separated and not in contact during said low power mode. That is, the motor speed of the or at least one centrifugal compressor is reduced compared with the normal power mode, yet it is high enough to exceed the so-called "lift-off" speed of the DGS so that these opposed seal faces are kept apart from one another.

The opposed seal faces typically have a rotating surface and a stationary surface. The rotating surface has a lifting geometry designed into it such that when it reaches a certain speed it is lifted off a stationary surface. This creates a minute gap with non-contacting surfaces which results in minimal gas leakage. Thus, in the context of the present invention "prevent contact" is intended to mean that said minute gap with non-contacting surfaces is present.

It will be appreciated that since there is a rotor speed that is non-zero during said low power mode, the centrifugal compressor(s) will be operating in such a way that compressed gas still is being produced. However, this gas will be recycled from the product end to the feed end of the compressor. In other words, during said low power mode, no net compressed gas is being produced since only recycled gas is being compressed.

The amount of power to the compressor required to prevent contact between said opposed seal faces depends on the design of not only the centrifugal compressor(s) but also the dry gas seals. Typically, however, a centrifugal compressor in low power mode will be operated above this minimum power threshold to ensure that contact is prevented. In the low power mode, the power to the centrifugal compressor is typically from about 5% to about 20%, e.g. from about 8% to about 15%, e.g. about 10%, of the maximum power for the compressor. The "lift-off" speed is the rotor speed (in rpm) required before the seal faces of a DGS move out of contact and will depend at least in part on the design of the DGS and the manufacturer. In this regard, the manufacturer of a given DGS will indicate the lift-off speed of the DGS. However, it should be noted that the lift-off speed of a DGS from one manufacturer may be different that of another manufacturer, even for a DGS of similar design. In addition, the lift-off speed may also change over time as the DGS ages and/or becomes contaminated. With this in mind, the rotor speed during low power mode is typically greater than, e.g. at least double or even three times, the lift-off speed indicated by the manufacturer to ensure non-contact of the seal surfaces in the DGS. For example, if the lift-off speed for a given DGS is 300 rpm, then the rotor speed during low power mode of a compressor using that DGS may be about 600 rpm or even 900 rpm.

It is within the ability of the skilled person to determine by trial a suitable rotor speed for the DGS in a centrifugal compressor operating in low power mode. For the purposes of illustration, however, the rotor speed during low power mode will be less than during normal power mode (e.g. about 3000 rpm to about 3500 rpm) and may be in the range from about 100 rpm to about 1500 rpm, e.g. from about 200 rpm to about 1000 rpm, or from about 400 rpm to 900 rpm.

The rotor speed of (or power supplied to) a centrifugal compressor, e.g for switching between a normal power mode and low power mode, can be manipulated using suitable means known to those skilled in the art, including but not limited to a variable frequency drive (VFD) and a mechanical drive. Other mechanical devices such as two-speed motors may be used.

It will be appreciated that a control system may also be used to monitor and control the rotor speed or amount of power of the centrifugal compressor(s).

Renewable Energy Sources

The process of the present invention comprises compressing a gas feed having a variable flow, such as gas produced using electricity generated at least in part from at least one renewable energy source.

Operation of the compression system will normally be dictated by gas produced using electricity from a renewable energy source (e.g. hydrogen gas from the electrolysers). Typically, the power required to produce gas for compression (e.g. using electrolysers) is much greater than the power needed to run the compressor(s). When low or no gas is being supplied, it will typically be injected from a gas storage system.

It is preferred that, in order to reduce environmental impact, that the process will be self-contained in terms of power generation for producing gas, and optionally, powering the centrifugal compressor(s). Thus, preferably the entire electricity demand for producing the gas for compression, and optionally for the centrifugal compressor(s), is met using renewable power sources, without supplementing said sources using non-renewable energy.

It will be appreciated that where the available electricity generated from the renewable energy source(s) is not sufficient for normal operation of the multistage compression system, putting the or at least one centrifugal compressor in low power mode puts the amount of net compressed gas being produced by said system at risk of being reduced. In such instances, it is preferred that the demand for compressed gas is met by feeding gas from a suitable gas storage system, before consideration of using any non-renewable energy sources to produce further gas (or to power the centrifugal compressors) is made.

Nonetheless, there may be instances where the demand for compressed gas cannot be met by either the gas being fed for compression (e.g. hydrogen from electrolysers) or the gas storage system. Thus, it will be envisaged that in some embodiments electricity generated from one or more renewable energy sources may be supplemented by other sources either during periods of particularly high demand of, for example, product(s) from the downstream process(es) and/or during periods when the renewable power source is only available below the threshold required to meet said demands of the process, or is not available at all, and the provision of gas from a gas storage system is not sufficient to meet said demands.

Thus, in some embodiments at least some additional electricity may be taken from onsite battery storage and/or generated from one or more onsite petrol-, diesel- or hydrogen-powered generator(s), including fuel cells and/or taken from a local or national grid.

Nevertheless, there may be instances where the electricity generated by the renewable energy source(s) and said additional electricity is still not sufficient for normal operation of the multistage compression system.

In these embodiments, the gas for compression is produced using, and centrifugal compressor(s) optionally powered by (i) electricity generated at least in part from at least one renewable energy source, and (ii) electricity from onsite battery storage and/or generated from one or more onsite petrol-, diesel- or hydrogen-powered generator(s).

Gas for Compression

The gas feed for compression in the multistage compression system may contain any gas suitable for compression in centrifugal compressors that has a variable flow rate. In the context of the present invention the centrifugal compressor(s) typically compress gas produced using electricity generated at least in part from at least one renewable energy source.

It is preferred that the gas for compression is hydrogen gas, preferably produced by electrolysis of water. Any suitable form of water electrolysis may be used including alkaline water electrolysis and polymer electrolyte membrane (PEM) water electrolysis.

The water used for the electrolysis is typically sea water that has been desalinated, possibly by reverse osmosis, and demineralized.

The electricity required for electrolysis may be generated at least in part from any suitable renewable energy source. In some preferred embodiments however, at least some of the electricity required for the electrolysis is generated from a renewable energy source including wind energy, solar energy, tidal energy and hydroelectric energy, or combinations of these sources, particularly wind energy and solar energy. The electricity generated from these sources may be used to provide power to the electrolysers.

Preferably, the process will be self-contained in terms of power generation for the electrolysis. Thus, preferably the entire electricity demand for the electrolysis is met using renewable power sources.

It is envisaged, however, that electricity generated from one or more renewable energy sources may be supplemented by other sources either during periods of particularly high demand for product(s) from the downstream process(es) and/or during periods when the renewable power source is only available below the threshold required to meet demand, or is not available at all. In these cases, additional electricity may be taken from onsite battery storage and/or generated from one or more onsite petrol-, diesel- or hydrogen-powered generator(s), including fuel cells and/or taken from a local or national grid.

The electrolysis may be carried out at any suitable scale, in some cases having a total capacity of less than 1 GW. However, in preferred embodiments the electrolysis has a total capacity of at least 1 gigawatt (GW). The maximum total capacity of the electrolysis is limited only by practical considerations, e.g. generating sufficient power from the renewable energy sources to power the plurality of electrolysers. Thus, the electrolysis may have a maximum total capacity of about 10 GW or more. The total capacity of the electrolysis may be from 1 GW to about 5 GW, e.g. from about 1.5 GW to about 3 GW, for example.

The hydrogen gas is typically generated by the electrolysis at pressure slightly higher than atmospheric pressure, e.g. about 1.3 bar. However, in some embodiments, the electrolysis produces hydrogen at a somewhat higher pressure, for example up to about 3 bar.

Thus, hydrogen gas is usually fed to the multistage compression system at a pressure in the range from atmospheric pressure to about 5 bar, e.g. from atmospheric pressure to about 3 bar, preferably in the range from atmospheric pressure to about 1.5 bar, e.g. about 1.1 bar.

In some embodiments, the amount of hydrogen gas produced by the electrolysers is variable and so during periods where there is insufficient hydrogen gas produced by electrolysis, for example where there is a flow of hydrogen gas which is lower than the maximum turndown capacity of a single centrifugal compressor, then gas may be fed to the multistage compression system from another source, e.g. a hydrogen storage system.

Purification

In preferred embodiments where the gas for compression is hydrogen gas produced by electrolysis, it will be noted that hydrogen gas produced by electrolysis is typically saturated with water at 40° C. Thus, this hydrogen gas usually contains some residual oxygen gas, typically about 500 to about 1000 ppm(v). These impurities will usually have to be removed, depending on the tolerances of any downstream process(es).

In this regard, oxygen is a poison for conventional catalysts used in the Haber process. Thus, in embodiments in which the downstream process is ammonia synthesis, the feed to the catalyst will contain less than about 10 ppm, typically less than about 5 ppm, total oxygen, i.e. oxygen atoms from any impurity source such as oxygen gas ($O_2$), water ($H_2O$), carbon monoxide (CO) and/or carbon dioxide ($CO_2$). Accordingly, the feed will also be dry, i.e. no more than 1 ppm water.

Downstream processes using conventional "grey" hydrogen (i.e. hydrogen derived from a hydrocarbon or carbonaceous feed stream without capture of carbon dioxide, e.g. by reforming natural gas), or "blue" hydrogen (i.e. hydrogen derived in the same way as grey hydrogen but where some or all of the carbon dioxide associated with production is captured), such as refineries, have similar tolerances for oxygen and water. However, hydrogen liquefaction usually has a tighter specification and requires no more than 10 ppb water and 1 ppm oxygen in the feed.

The compressed hydrogen gas produced by the electrolysis is preferably purified prior to being fed to the downstream process. In this regard, the residual oxygen gas in the compressed hydrogen gas may be converted into water by catalytic combustion of some of the hydrogen to produce oxygen-depleted compressed hydrogen gas (containing no more than 1 ppm $O_2$) which may then be dried to produce dry compressed hydrogen gas (containing no more than 1 ppm water) for use in the downstream process(es).

Multistage Compression System

The multistage compression system is responsible for compressing gas from the pressure at which the gas is generated to an elevated pressure. For example, where at least some of the compressed gas is fed to at least one downstream process, the elevated pressure will generally be a pressure that is at least little higher than the feed pressure of said downstream process(es).

As will be readily appreciated, a "multistage" compression system has a plurality of stages of compression that may be split between compressors in parallel and/or in series. The overall pressure ratio across each stage is generally in the range of about 1.5 to about 2.5, e.g. about 2 to about 2.5, in order to limit the increase in temperature of the compressed gas.

Coolers are typically required between adjacent stages ("inter-coolers") and typically required after a final stage ("after-coolers") in multistage compression systems to remove heat of compression from compressed gas. Thus, in the context of the present invention, a "stage" of compression refers to the part of the compression system between coolers.

The compressed hydrogen gas produced by the multistage compression system typically has a pressure from about 10 bar to about 50 bar. In some embodiments, the pressure of the compressed hydrogen gas is from about 25 bar to about 35 bar, preferably about 30 bar. In other embodiments, the pressure of the compressed hydrogen gas is from about 10 bar to about 12 bar, preferably about 11 bar.

In some embodiments, the multistage compression system has only a single section to compress the hydrogen gas to the desired elevated pressure. In other embodiments, the multistage compression system comprises a first section and at least one further section downstream of the first section.

In particular embodiments, the multistage compression system has two sections, a first (low pressure or "LP") section in which hydrogen gas is compressed from the feed pressure to the multistage compression system to a first elevated pressure in the range from about 2 bar to about 6 bar, and a second (medium pressure or "MP") section in which hydrogen gas is compressed from the first elevated pressure to the final elevated pressure desired for the downstream process(es).

In some embodiments, the first elevated pressure of the hydrogen gas after compression in the first section may be in the range of about 2 bar to about 3 bar, e.g. 2.5 bar. In other embodiments, the first elevated pressure may be in the range of about 4 bar to about 6 bar, e.g. 5 bar.

In preferred embodiments, the multistage compression system will comprise phase separators upstream of each stage of compression to remove liquid water. For LP centrifugal compressors, the phase separator will usually be combined into the intercooler as a single unit to potentially enable capital and power benefits and simplify the system.

Downstream Process(es)

In some embodiments, the compressed gas may be consumed in a downstream process, or in more than one downstream process arranged in parallel.

In preferred embodiments where the gas for compression is hydrogen gas, the downstream process(es) could include any process that would currently use "grey" hydrogen or "blue" hydrogen. Such processes include oil refining and steel manufacture.

In still preferred embodiments, at least some, e.g. all, of the compressed gas is hydrogen gas used to produce ammonia via the Haber (or Haber-Bosch) process. In this process, ammonia is produced by reacting a mixture of hydrogen and nitrogen gases over an iron-based catalyst at high temperature, typically at about 400° C. to about 500° C., and at high pressure, typically at a pressure in the range from about 100 bar to 200 bar.

In other preferred embodiments, at least some, e.g. all of the compressed gas is hydrogen gas used to produce methanol, e.g. via $CO_2$ hydrogenation.

In some embodiments, at least some, e.g. all, of the compressed gas is hydrogen gas used to produce ammonia and/or methanol.

In other embodiments, at least some, e.g. all, of the compressed hydrogen gas is liquefied by cryogenic cooling.

In still further embodiments, a first part of the compressed hydrogen gas is used to produce ammonia and a second part of the compressed hydrogen gas is liquefied.

Return of Stored Gas

One of the drawbacks of using electricity generated from a renewable energy source (e.g. to produce gas) is the inherent fluctuations in the availability of the energy source, in turn leading to fluctuations in the flow of the gas feed to the system. In some embodiments, this problem may be addressed (albeit temporarily) in the present invention by providing a system for collecting and storing at least some, preferably all, of the excess gas produced during periods when production exceeds demand from a downstream process(es), and distributing stored gas to said downstream process(es) during periods when the demand exceeds production.

In the context of the present invention, using a storage system may be particularly useful where the first number (n) of compressors producing net compressed gas reaches 1, i.e. only one compressor is operating and the remaining compressors are in a low power mode or switched off. In the context of process where the gas is produced using renewable energy and the multistage compression system is powered by renewable energy, it may be more energy efficient to shut down the final centrifugal compressor or put it in low power mode to avoid excessive recycling of gas and reduce energy consumption to conserve electricity.

Therefore, once the last centrifugal compressor is unloaded, there may still be some flow of gas in the gas feed to the multistage compression system, and the presence of a storage system allows collection of this gas for it to be compressed later.

In some embodiments, the compressed gas may be stored without further compression. In these embodiments, the gas is stored at a pressure up to a maximum pressure of the pressure to which the gas is compressed in the multistage compression system, e.g. a pressure up to a maximum of about the feed pressure of the downstream process (where there is only one) or about the feed of one of the downstream processes (if there are more than one). In such embodiments, the compressed gas may perhaps be stored at a pressure up to a maximum pressure in the region of about 25 bar to about 30 bar.

The compressed gas may however be further compressed prior to storage. In these embodiments, compressed gas may be stored at a pressure up to a maximum of about 200 bar, or up to a maximum of about 150 bar, or up to a maximum of about 100 bar, or up to a maximum of about 90 bar, or up to a maximum of about 80 bar, or up to a maximum of about 70 bar, or up to a maximum of about 60 bar, or up to a maximum of about 50 bar.

During periods when the level of demand for the gas exceeds the production level, compressed gas is removed from storage and reduced in pressure to produce reduced pressure gas. Pressure may be reduced in any conventional manner, particularly by passing the gas through a valve.

The pressure of the reduced pressure gas will depend on the pressure at the point in the multistage compression system to which the reduced pressure gas is to be added.

In some embodiments, reduced pressure gas may be fed to a final stage of the multistage compression system. In these embodiments, the reduced pressure gas will be at the inlet pressure of the feed to the final stage.

In other embodiments, reduced pressure gas may be fed to an intermediate stage of the multistage compression system. In these embodiments, the reduced pressure gas will be at the inlet pressure of the feed to the intermediate stage.

The intermediate stage may be an intermediate stage within a compression section or, where there are two or more sections in the multistage compression system, the initial stage within a further compression section downstream of a first compression section. In these embodiments, the reduced pressure gas from storage will be at the inlet pressure of the feed to the further compression section, i.e. the "inter-section" pressure.

In still further embodiments, the reduced pressure gas may be fed to the feed end, i.e. to the initial stage, of the multistage compression system. In these embodiments, the reduced pressure gas will be the feed pressure to the multistage compression system, e.g. about 1.1 bar.

During periods when demand exceeds production, the process may comprise:

reducing the pressure of the compressed gas withdrawn from storage to produce reduced pressure gas at the inlet pressure to a first stage of the multistage compression system (a first intermediate pressure); and feeding the reduced pressure gas to the first stage.

In such embodiments, once the pressure of the compressed gas in storage falls to about the inlet pressure of the first stage, the method may comprise:

reducing further the pressure of the compressed gas withdrawn from storage to produce reduced pressure gas at an inlet pressure to a second stage of the multistage compression system upstream of the first stage (a second intermediate pressure); and feeding the reduced pressure gas to the second stage.

It will be understood that the terms "first stage" and "second stage" in this context do not refer to the relative positions of the stages in the multistage compression system in the downstream direction during normal operation. In contrast, the terms are merely intended to reflect the order of the stages to which reduced pressure gas is fed to the multistage compression system during periods when demand exceeds production. The terms "first intermediate pressure" and "second intermediate pressure" should be interpreted accordingly with the first intermediate pressure being higher than the second intermediate pressure.

These embodiments may further comprise feeding reduced pressure gas to other stages of the multistage compression system upstream of the first and second stages. In these further embodiments, the pressure of the compressed gas withdrawn from storage is reduced to the inlet pressure to the respective stages.

In some preferred embodiments, the second stage is the initial stage of the multistage compression system.

It will be appreciated that, in embodiments where reduced pressure gas is fed to a second stage after the first stage, gas flow to the first stage is stopped when gas flow to the second stage starts. Generally speaking, flow of reduced pressure gas to a given compression stage is stopped when flow of reduced pressure gas to another compression stage starts.

In some preferred embodiments, wherein during feeding of said reduced pressure gas to a stage, the centrifugal compressor or, if more than one, at least one centrifugal compressor upstream of said stage is operating in said low power mode.

Since gas can be returned from storage to an intermediate stage and/or the initial stage of the multistage compression system, the compressed gas may be stored at a pressure down to a minimum of about 5 bar, perhaps even down to a minimum of about 1.3 bar.

In embodiments in which compressed gas is further compressed before being stored, another option would be for compressed gas withdrawn from storage to be fed, after suitable pressure reduction, directly to a downstream process(es) until the storage pressure falls to the feed pressure of said downstream process(es). At that point, the pressure of the compressed gas withdrawn from storage would be reduced further and the reduced pressure gas fed to a stage of the multistage compression system in accordance with the present invention. However, these embodiments are not preferred, e.g. because of the additional capital expense of the high-pressure storage system.

The term "suitable" in the context of pressure reduction for the storage system is intended to mean that the pressure of the gas is reduced to an appropriate extent having regard to the inlet pressure of the stage of the multistage compression system to which the reduced pressure gas is fed.

Compared to a high-pressure storage system with discharge only to the feed pressure of a downstream process, these embodiments of the present invention enable the storage volume of gas to be reduced by using the multistage compression system that is already present in the process to recompress gas from storage when the storage pressure drops below that feed pressure. The gas can thereby continue to be taken from storage until the storage pressure falls to a minimum of the feed pressure to the multistage compression system.

Additional compression power is required during periods when gas production is limited by lack of power, e.g. to the electrolysers, but the additional compression power can be minimized by supplying gas at the highest compressor inter-stage pressure possible given the storage pressure at a particular time. It also allows the maximum gas storage pressure to be at or below the feed pressure of any downstream process to eliminate any additional compression requirement for gas to storage.

It will be appreciated that the same volume of gas is stored in the same storage volume at the same maximum pressure and that reducing the minimum storage pressure increases the "releasable" volume of gas from storage, i.e. the usable volume of stored gas.

The inventors have, however, realized that where gas is produced and then compressed in a multistage compression system for use in at least one downstream process, the releasable volume of stored gas may be increased by returning gas from storage to a stage in the multistage compression system rather than directly to the downstream process, and that this arrangement reduces the overall storage vessel volume required by the process.

By way of example, storage from a maximum pressure of 200 bar to a minimum pressure of 1.5 bar requires 15% less storage vessel volume for a given mass of releasable gas compared to storage from a maximum pressure of 200 bar to a minimum pressure of 30 bar.

Similarly, storage from a maximum pressure of 100 bar to a minimum pressure of 1.5 bar requires 30% less storage vessel volume for a given mass of releasable gas compared to storage from a maximum pressure of 100 bar to a minimum pressure of 30 bar.

In addition, storage from a maximum pressure of 50 bar to a minimum pressure of 1.5 bar requires 60% less storage vessel volume for a given mass of releasable gas compared to storage from a maximum pressure of 50 bar to a minimum pressure of 30 bar.

Further, storage from a maximum pressure of 30 bar to a minimum pressure of 1.5 bar is feasible compared to 30 bar to 30 bar which would allow no storage.

Moreover, although the total storage vessel volume increases as the maximum storage pressure is reduced, the lower design pressure makes the vessel walls thinner and can reduce the overall capital cost of the storage system. The vessel thickness is often limited to a maximum value by considerations such as manufacturability, and in that case the lower design pressure will lead to fewer vessels (although each vessel will be larger). Furthermore, the allowable stress for the design of a vessel may be increased below a particular vessel wall thickness, and if the lower design pressure allows the thickness to be below this threshold, the total vessel metal mass (and therefore the total cost) can be reduced.

Apparatus

In a second aspect of the present invention, there is provided an apparatus for operating a multistage compression system compressing a gas feed having a variable flow rate according to the process of the present invention, said apparatus comprising:

- a multistage compression system comprising a feed end, a plurality (N) of centrifugal compressors in parallel, a product end, and a main recycle system for recycling gas through the plurality (N) of centrifugal compressors, wherein each centrifugal compressor comprises an inlet, an outlet, and a local recycle system with anti-surge control that recycles gas from the outlet to the inlet;
- a control system for controlling the load of each centrifugal compressor and for controlling the amount of recycling by the main recycle system and local recycle system, as required, based on the flow of the feed gas.

Electricity Generation System

In some preferred embodiments, the apparatus comprises an electricity generation system for generating electricity from at least one renewable energy source, and wherein the gas for compression is produced at least in part using electricity generated from said electricity generation system.

Electricity for producing the gas for compression (and possibly for powering the or each centrifugal compressor of the multistage compression system) is generated from at least one renewable energy source, e.g. wind energy and/or solar energy.

It is preferred that, in order to reduce environmental impact, that the process will be self-contained in terms of power generation for producing gas for compression (and optionally powering the centrifugal compressor(s)). Thus, preferably the entire electricity demand is met using renewable power sources, without supplementing said sources using non-renewable energy. In such instances, it is preferred that the demand for compressed gas is met by feeding gas from a suitable storage system, before consideration of using any non-renewable energy sources is made.

However, there may not be sufficient gas available to be fed from said storage system, for example. Thus, in some embodiments the electricity generation system comprises onsite battery storage and/or one or more onside petrol-, diesel- or hydrogen-powered generator(s). Electricity from said battery storage and/or one or more onside petrol-, diesel- or hydrogen-powered generator(s) may be used to supplement additional electricity either during periods of particularly high demand of, for example, product(s) from the downstream process(es) and/or during periods when the renewable power source is only available below the threshold required to meet said demands of the process, or is not available at all.

In embodiments in which wind energy is used to generate electricity, the electricity generation system will comprise a plurality of wind turbines. In embodiments in which solar energy is used to generate electricity, the electricity generation system will comprise a plurality of photovoltaic cells, or "solar cells".

Some embodiments will comprise a plurality of wind turbines and a plurality of photovoltaic cells.

The expression "electrically conductive communication" will be understood to mean that appropriate wires and/or cables will be used, together with any other relevant equipment, to connect the electricity generation system with the or each compressor in a safe and efficient manner.

In the context of the present invention, the or each centrifugal compressor may also be driven by a dedicated variable frequency drive, a mechanical drive or a two-speed motor.

In some preferred embodiments, the electricity generation system also generates electricity for powering the centrifugal compressor(s) of the multistage compression system and/or any downstream process(es).

Multistage Compression System

The multistage compression system comprises a plurality (N) of centrifugal compressors. A first number (n) of the centrifugal compressors are operating to produce net compressed gas, whilst the remaining centrifugal compressors are in a low power mode or in shut down.

As mentioned above, the multistage compression system typically comprises a plurality of stages, each stage typically having a compression ratio in the range of about 2 to about 2.5. Inter-coolers are typically provided between adjacent stages, and after-coolers may be required after a final stage.

The multistage compression system also comprises a main recycle system for recycling gas through the plurality of (N) of centrifugal compressors. Each centrifugal compressor also has a local recycle system for recycling gas form the outlet to the inlet of the compressor, the local recycle system having an anti-surge control.

The stages of a multistage compression system may be arranged in at least two compression sections, a first and a further section downstream of said first section.

Each section may comprise one or more stages of compression, together with the associated coolers. Phase separators may also be included upstream of each compression stage to remove liquids from the hydrogen gas to be compressed.

In particular embodiments, the multistage compression system has two sections, a first (low pressure or "LP") section in which hydrogen gas is compressed from the feed pressure to the multistage compression system to a first elevated pressure, and a further (medium pressure or "MP") section in which hydrogen gas is compressed from the first elevated pressure to the final elevated pressure desired for the downstream process(es).

An LP section may have one or more, e.g. two, stages of compression and an MP section may have two or more, e.g. 3 or 4, stages of compression.

The number of compressors used will depend on the total capacity of the process. By way of example, for a process having a total electrolysers capacity of 2.2 GW (for producing hydrogen gas), the multistage compression system may have from 8 to 10 compressors. The skilled person would appreciate that a process having a higher total capacity would require a greater number of compressors.

Compressors in an LP section may be oversized as appropriate, e.g. by 10%, to accommodate the loss of a machine. Additionally or alternatively, the multistage compression system may comprise a spare compressor in either the LP or an MP section which would cut-in to replace another machine in the relevant section that had broken down.

Control System

The apparatus comprises a control system for controlling the load of each centrifugal compressor and for controlling the amount of recycling by the main recycle system and local recycle system, as required, based on the flow of the feed gas.

In embodiments where there is an electricity generation system that dictates the flow of the gas feed, the electricity generation system generates electricity from at least one renewable energy source. However, as mentioned above in some embodiments the electricity generation system further comprises onsite battery storage and/or generates electricity from one or more onside petrol-, diesel- or hydrogen-powered generator(s). In such embodiments, the apparatus comprises a control system for switching the or each centrifugal compressor between a normal power mode and a low power mode, as required, based on the level of electricity generated by the at least one renewable energy source(s) and onsite battery storage and/or one or more onside petrol-, diesel- or hydrogen-powered generator(s) of said electricity generation system.

It will be appreciated that the control system is in electrical communication with the or each centrifugal compressor in the multistage compression system.

The control system implements the process of the invention.

The control system is thus configured to:

(a) during periods when the gas feed is received by the multistage compression system at a flow equal to the total maximum capacity of a first number (n) of centrifugal compressors producing net compressed gas, operate said first number (n) of centrifugal compressors at full load for compressing the gas feed;

(b) during periods when the gas feed is received by the multistage compression system at a flow in a range from less than total maximum capacity of said first number (n) of centrifugal compressors to total turndown capacity of said first number (n) of centrifugal compressors, operate said first number (n) of centrifugal compressors at minimum load for compressing the gas feed, said minimum load being determined based on the flow of the gas feed;

(c) during periods when the gas feed is received by the multistage compression system at a flow in a range from less than total turndown capacity of the first number (n) of centrifugal compressors to more than total maximum capacity for a second number (n−1) of centrifugal compressors producing net compressed gas, recycle compressed gas using the main recycle system as required to maintain the load of said first number (n)

of centrifugal compressors above the point at which anti-surge controls are activated; and (d) during periods when the gas feed is received by the multistage compression system at a flow equal to the total maximum capacity for said second number (n−1) of centrifugal compressors, unloading a centrifugal compressor to put said compressor into a low power mode or shutdown mode in which said compressor produces no net compressed gas, while simultaneously loading the remaining centrifugal compressors to maximum capacity, In other words, the control system simply monitors the gas flow in the gas feed to the multistage compression system, and then signals each centrifugal compressor to operate according to the process described herein.

Thus, the control system dictates the most efficient way to operate the centrifugal compressor(s) of the multistage compression system, without unduly shutting down the centrifugal compressors, and/or preserving electricity, thus allowing for more electricity to be "freed up" for other parts of the process, e.g. gas production, or any downstream process(es), and/or allows for a more stable output of net compressed gas from the system by avoiding activation of anti-surge controls.

Electrolysers

In some preferred embodiments the gas for compression is hydrogen gas, preferably produced by electrolysis of water. Thus, in said embodiments, the apparatus comprises a plurality of electrolysers for producing hydrogen gas, wherein said feed end of said multistage compression system is in fluid flow communication with said plurality of electrolysers. The electrolysers are powered at least in part by electricity generated from said electricity generation system.

The electrolysis of water may be provided by a plurality of electrolysis units or "cells". Each unit or cell may be referred to as an "electrolyser".

The plurality of electrolysers typically has a total capacity of at least 1 GW, but in some instances the capacity may be less than 1 GW. The maximum total capacity of the electrolysers is limited only by practical considerations, e.g. generating sufficient power from the renewable energy source(s) to power the plurality of electrolysers. Thus, the electrolysers may have a maximum total capacity of 10 GW or more. The total capacity of the electrolysers conducting the electrolysis may be from 1 GW to 5 GW, e.g. from about 1.5 GW to about 3 GW.

The plurality of electrolysers usually consists of a large number, e.g. hundreds, of individual cells combined into "modules" that also include process equipment, e.g. pumps, coolers, and/or separators, etc., and groups of these modules are typically arranged in separate buildings.

Each module typically has a maximum capacity of at least 10 MW, e.g. 20 MW, and each building typically has a total capacity of at least 100 MW, e.g. 400 MW.

Any suitable type of electrolyser may be used with the present invention. In this regard, there are three conventional types of electrolyser—alkaline electrolysers, PEM electrolysers and solid oxide electrolysers—and each of these types of electrolyser is in theory suitable for use with the present invention.

Alkaline electrolysers operate via transport of hydroxide ions ($OH^-$) through the electrolyte from the cathode to the anode with hydrogen being generated on the cathode side. Electrolysers using a liquid alkaline solution of sodium hydroxide or potassium hydroxide as the electrolyte are commercially available. Commercial alkaline electrolysers typically operate at a temperature in the range of about 100° C. to about 150° C.

In a PEM electrolyser, the electrolyte is a solid plastics material. Water reacts at the anode to form oxygen and positively charged hydrogen ions. The electrons flow through an external circuit and the hydrogen ions selectively move across the PEM to the cathode. At the cathode, hydrogen ions combine with electrons from the external circuit to form hydrogen gas. PEM electrolysers typically operate at a temperature in the range of about 70° C. to about 90° C.

Solid oxide electrolysers use a solid ceramic material as the electrolyte that selectively conducts negatively charged oxygen ions ($O^{2-}$) at elevated temperatures. Water at the cathode combines with electrons from the external circuit to form hydrogen gas and negatively charged oxygen ions. The oxygen ions pass through the solid ceramic membrane and react at the anode to form oxygen gas and generate electrons for the external circuit. Solid oxide electrolysers must operate at temperatures high enough for the solid oxide membranes to function properly, e.g. at about 700° C. to about 800° C.

Due to the lower operating temperatures, the use of alkaline electrolysers and/or PEM electrolysers are typically preferred.

The plurality of electrolysers may be arranged in at least two parallel groups. In these embodiments, the apparatus comprises:

- a first header to collect hydrogen gas from each electrolyser in each group; and
- a second header to collect hydrogen gas from the first headers and feed the hydrogen gas to the feed end of the multistage compression system;

In some embodiments wherein the apparatus further comprises a storage system for storing compressed hydrogen gas, the apparatus further comprises a conduit for feeding compressed hydrogen gas from a storage system after suitable pressure reduction to the second header.

Any suitable source of water may be used with these embodiments of the present invention. However, in embodiments in which sea water is used to produce the water for the electrolysis, the apparatus would further comprise at least one unit (or plant) for desalination and demineralization of the sea water.

Purification System

In some embodiments where there is a downstream process(es) that cannot tolerate the levels of water and oxygen inherently present in the compressed hydrogen gas produced by the electrolysis of water, the apparatus may comprise a purification system in which the compressed hydrogen gas is purified.

The purification system will typically comprise a "DeOxo" unit in which oxygen is removed by the catalytic combustion of hydrogen to produce water and oxygen-depleted compressed hydrogen gas.

The oxygen-depleted gas may then be dried in a drier, e.g. an adsorption unit, such as a temperature swing adsorption (TSA) unit, to produce dry compressed hydrogen gas for the downstream process(es).

Downstream Processing Unit(s)

In some embodiments, the apparatus comprises at least one downstream processing unit for consuming compressed gas, said downstream processing unit(s) being in fluid flow communication with said outlet end of said multistage compression system.

A downstream processing unit may be any unit that utilizes gas (e.g. hydrogen gas) as a feedstock.

Examples of suitable downstream processing units include an oil refinery, a steel manufacturing facility, an ammonia synthesis plant or a hydrogen liquefaction plant. In some embodiments, there is both an ammonia synthesis plant and a hydrogen liquefaction plant arranged in parallel.

In particularly preferred embodiments the downstream processing unit(s) includes an ammonia synthesis plant, e.g. using the Haber (Haber-Bosch) process, and/or a methanol synthesis plant, e.g. using $CO_2$ hydrogenation.

Storage System

In some embodiments, the apparatus comprises a storage system for storing compressed gas, said storage system being in fluid flow communication with said outlet end of said multistage compression system and at least one compressor of said multistage compression system.

The storage system typically comprises a number of pressure vessels and/or pipe segments connected to a common inlet/outlet header.

The pressure vessels may be spheres, e.g. up to about 25 m in diameter, or "bullets", i.e. horizontal vessels with large L/D ratios (typically up to about 12:1) with diameters up to about 12 m.

Salt domes may also be used if the geology of the site allows.

In some embodiments the apparatus comprises a second control system that controls not only the pressure and flow of compressed from the multistage compression system to the storage system, e.g. during periods when gas production exceeds demand, but also the pressure and flow of compressed gas to the multistage storage system, e.g. during periods when gas demand exceeds production.

It will be appreciated that this second control system could be integral with, or separate to, the control system described above in relation to the centrifugal compressor(s).

In some embodiments, the second control system would simply seek to maintain the pressure of gas in a downstream header to a downstream process. Thus, in order to continually provide a given amount of gas to the downstream process, a pressure controller would be maintained on a discharge header that feeds the downstream process.

If the pressure in the discharge header exceeded the required feed pressure (e.g. because there is more gas available than the downstream process is consuming), the pressure would be relieved by opening a valve in the feed line to storage.

Once the pressure in the discharge header dropped to the required feed pressure, the valve in the feed line to storage would be closed.

If the pressure in the discharge header dropped below the required feed pressure (e.g. because there is less gas available than the downstream process is consuming), the pressure would be increased by opening a valve in a first return line from storage to a first stage in the multistage compression system.

The valve in the first return line would remain open until such time that the pressure in the discharge header exceeded the required feed pressure, indicating that the level of gas production has returned to the required level, at which point the valve would be closed, or until the pressure in the storage vessel drops to about the inlet pressure to the first stage of multistage compression system being fed by the first return line.

In the latter case, not only would the valve in the first return line be closed, but also a valve in a second return line from storage to a second stage in the multistage compression system (upstream of the first stage) would be opened so as to continue to feed gas from storage back to the downstream process.

Such a control system may be referred to as a "split range" control system.

Aspects of the invention include:

#1. A process for operating a multistage compression system compressing a gas feed having a variable flow rate, said multistage compression system comprising a feed end, a plurality (N) of centrifugal compressors in parallel, a product end, and a main recycle system for recycling gas through the plurality (N) of centrifugal compressors, wherein each centrifugal compressor comprises an inlet, an outlet, and a local recycle system with anti-surge control for recycling gas from the outlet to the inlet, said process comprising:

(a) during periods when the gas feed is received by the multistage compression system at a flow equal to the total maximum capacity of a first number (n) of centrifugal compressors producing net compressed gas, operating said first number (n) of centrifugal compressors at full load for compressing the gas feed;

(b) during periods when the gas feed is received by the multistage compression system at a flow in a range from less than total maximum capacity of said first number (n) of centrifugal compressors to total turndown capacity of said first number (n) of centrifugal compressors, operating said first number (n) of centrifugal compressors at minimum load for compressing the gas feed, said minimum load being determined based on the flow of the gas feed;

(c) during periods when the gas feed is received by the multistage compression system at a flow in a range from less than total turndown capacity of the first number (n) of centrifugal compressors to more than total maximum capacity for a second number (n−1) of centrifugal compressors producing net compressed gas, recycling compressed gas using the main recycle system as required to maintain the load of said first number (n) of centrifugal compressors above the point at which anti-surge controls are activated; and (d) during periods when the gas feed is received by the multistage compression system at a flow equal to the total maximum capacity for said second number (n−1) of centrifugal compressors, unloading a centrifugal compressor to put said compressor into a low power mode or shutdown mode in which said compressor produces no net compressed gas, while simultaneously loading the remaining centrifugal compressors to maximum capacity, wherein the process is reversible at any point, and wherein n is a whole number equal to or less than N.

#2. A process according to #1, wherein the gas for compression is hydrogen gas.

#3. A process according to #2, wherein the hydrogen gas is produced by electrolysis of water.

#4. A process according to any of #1 to #3, wherein the gas for compression is produced at least in part using electricity generated from at least one renewable energy source.

#5. A process according to any of #1 to #4, wherein during periods specified in (b) the turndown capacity of each centrifugal compressor is defined as the minimum flow of gas that can be compressed by the centrifugal compressor without activation of its anti-surge control.

#6. A process according to any of #1 to #5, wherein during periods specified in (b) the turndown capacity of each centrifugal compressor is from 60% or more of maximum gas flow through the centrifugal compressor.

#7. A process according to any of #1 to #6, wherein during periods specified in (b) the flow of the gas feed is distributed uniformly across all (n) centrifugal compressors at minimum load.

#8. A process according to any of #1 to #7, wherein during periods specified in (c) the amount of recycling of compressed gas is maintained at a minimum amount to conserve electricity.

#9. A process according to any of #1 to #8, wherein during periods specified in (d) the unloading of the centrifugal compressor comprises first reducing the flow of net compressed gas through said centrifugal compressor to zero using the local recycle system, and second reducing the load of said centrifugal compressor.

#10. A process according to any of #1 to #9, wherein putting a centrifugal compressor in low power mode comprises reducing the rotor speed of the centrifugal compressor to a speed that is still sufficient to prevent contact of opposed seal faces of a dry gas seal within the centrifugal compressor.

#11. A process according to any of #1 to #10, wherein unloading to put a centrifugal compressor in said low power mode comprises reducing its rotor speed to within a range of from about 100 rpm to about 1500 rpm and operating such that it produces no net compressed gas.

#12. A process according to any of #1 to #11, wherein during operation in said low power mode the centrifugal compressor is operating with a power of about 20% or less relative to maximum power and producing no net compressed gas.

#13. A process for supplying compressed hydrogen gas for consumption in at least one downstream process, comprising:

producing said hydrogen gas from electrolysis of water, compressing said hydrogen gas in a multistage compression system operated according to any of #1 to #12, and feeding said compressed hydrogen gas to at least one downstream process for consumption in said downstream process(es).

#14. A process according to any of #2 to #13, wherein at least some of the compressed hydrogen gas is used to produce ammonia and/or methanol in the downstream process(es).

#15. An apparatus for operating a multistage compression system compressing a gas feed having a variable flow rate according to #1, said apparatus comprising:

a multistage compression system comprising a feed end, a plurality (N) of centrifugal compressors in parallel, a product end, and a main recycle system for recycling gas through the plurality (N) of centrifugal compressors, wherein each centrifugal compressor comprises an inlet, an outlet, and a local recycle system with anti-surge control that recycles gas from the outlet to the inlet;

a control system for controlling the load of each centrifugal compressor and for controlling the amount of recycling by the main recycle system and local recycle system, as required, based on the flow of the feed gas.

#16. The apparatus according to #15, comprising:

an electricity generation system for generating electricity from at least one renewable energy source, and wherein the gas for compression is produced at least in part using electricity generated from said electricity generation system.

#17. An apparatus according to #16, wherein the gas for compression is hydrogen gas, the apparatus comprising:

a plurality of electrolysers for producing said hydrogen gas, wherein the electrolysers are powered at least in part by electricity generated from said electricity generation system, and wherein said feed end of said multistage compression system is in fluid flow communication with said plurality of electrolysers.

#18. The apparatus according to any of #15 to #17, comprising at least one downstream processing unit for consuming compressed gas, said downstream processing unit(s) being in fluid flow communication with said outlet end of said multistage compression system.

#19. The apparatus according to any of #15 to #18, comprising:

a storage system for storing compressed gas, said storage system being in fluid flow communication with said outlet end of said multistage compression system and at least one compressor of said multistage compression system; and a second control system for controlling pressure and flow of compressed gas from said multistage compression system to said storage system and for controlling pressure and flow of compressed gas from said storage system to said compressor(s) of said multistage compression system based on the flow of the gas feed to the multistage compression system.

EXAMPLES

The invention will now be described by example only and with reference to the figures in which.

Figure 1:
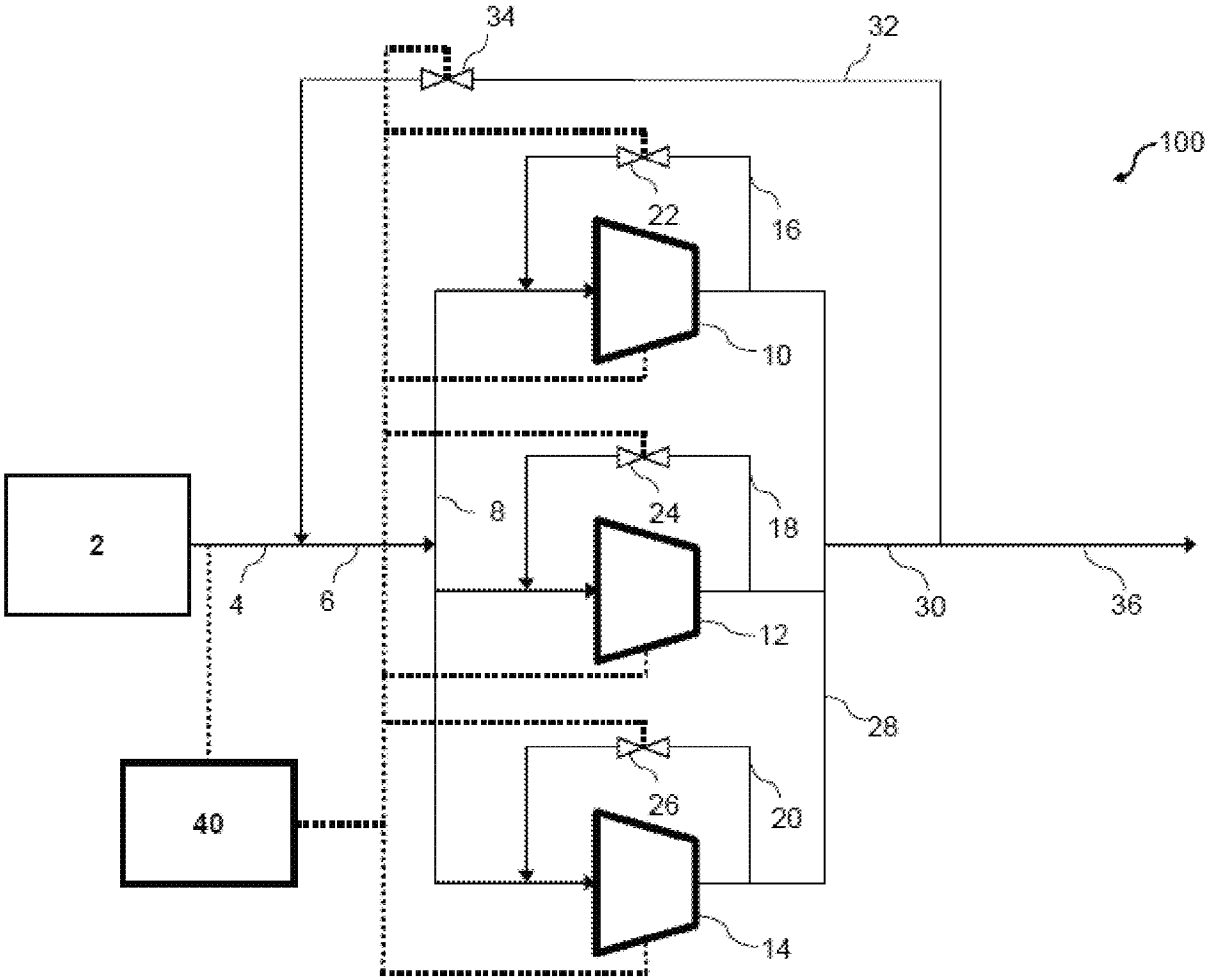
FIG. 1 is a simplified flowsheet for a first embodiment of the present invention.

According to FIG. 1, hydrogen is produced at about atmospheric pressure by electrolysis of water in a plurality of electrolyser units indicated generally by reference numeral 2.

The electricity required to power the electrolysers 2 is generated at least in part by renewable energy sources (not shown) such as the wind and/or the sun. In some embodiments, however, at least some additional electricity may be taken from onsite battery storage and/or generated from one or more onsite petrol-, diesel- or hydrogen-powered generator(s), including fuel cells and/or taken from a local or national grid (not shown).

A stream 4 of hydrogen gas is removed from the electrolysers 2 at a pressure just over atmospheric pressure (e.g. about 1.1 bar) and is fed a multistage compression system 100 to produce a stream 36 of compressed hydrogen gas. In this example, the multistage compression system 100 comprises three centrifugal compressors, 10, 12 and 14, that are arranged in parallel.

Stream 4 has recycled hydrogen gas added to it, as required, to form combined stream 6, which is then fed to header 8 before being compressed in parallel compressors 10, 12, and 14. Compressed hydrogen gas from each of the centrifugal compressors 10, 12, and 14 is fed to header 28 and forms the combined stream 30 of compressed hydrogen gas. Combined stream 30 may have optionally have gas removed from it for recycling, before being fed as stream 36 to a downstream stage of compression (not shown) or at least one downstream process (not shown).

The multistage compression system 100 includes a main recycle system 32 which removes gas from combined stream 30 and, after suitable pressure reduction in valve 34, feeds it to the inlet of the multistage compression system by combining it with stream 4 to form stream 6.

Each centrifugal compressor 10, 12, and 14 also has an associated local recycle system 16, 18 and 20, with valves 22, 24, and 26 respectively, each local recycle system has anti-surge control. Each recycle system removes compressed gas from the product end and, after suitable pressure reduction with a valve (22, 24, 26), feeds it to the feed end of the associated centrifugal compressor.

Each centrifugal compressor 10, 12, and 14 is electrically connected to a control system, indicated by reference numeral 40. The control system 40 monitors the amount of gas flow to the multistage compression system and accordingly controls the load of the centrifugal compressors 10, 12 and 14. The valve of the main recycle system (34) and the valves of the local recycle systems 22, 24 and 26 are also electrically connected to the control system, such that the amount of recycling by the recycle systems, as well as the amount of recycling by the main recycle system, is controlled to implement the process of the present invention as required.

Although not shown for brevity, the multistage compression system 100 typically comprises inter-coolers between stages of compression and after-coolers after a final stage. There may also be phase separators upstream of each stage of compression to remove liquid from the stream entering the compressors.

Figure 2:
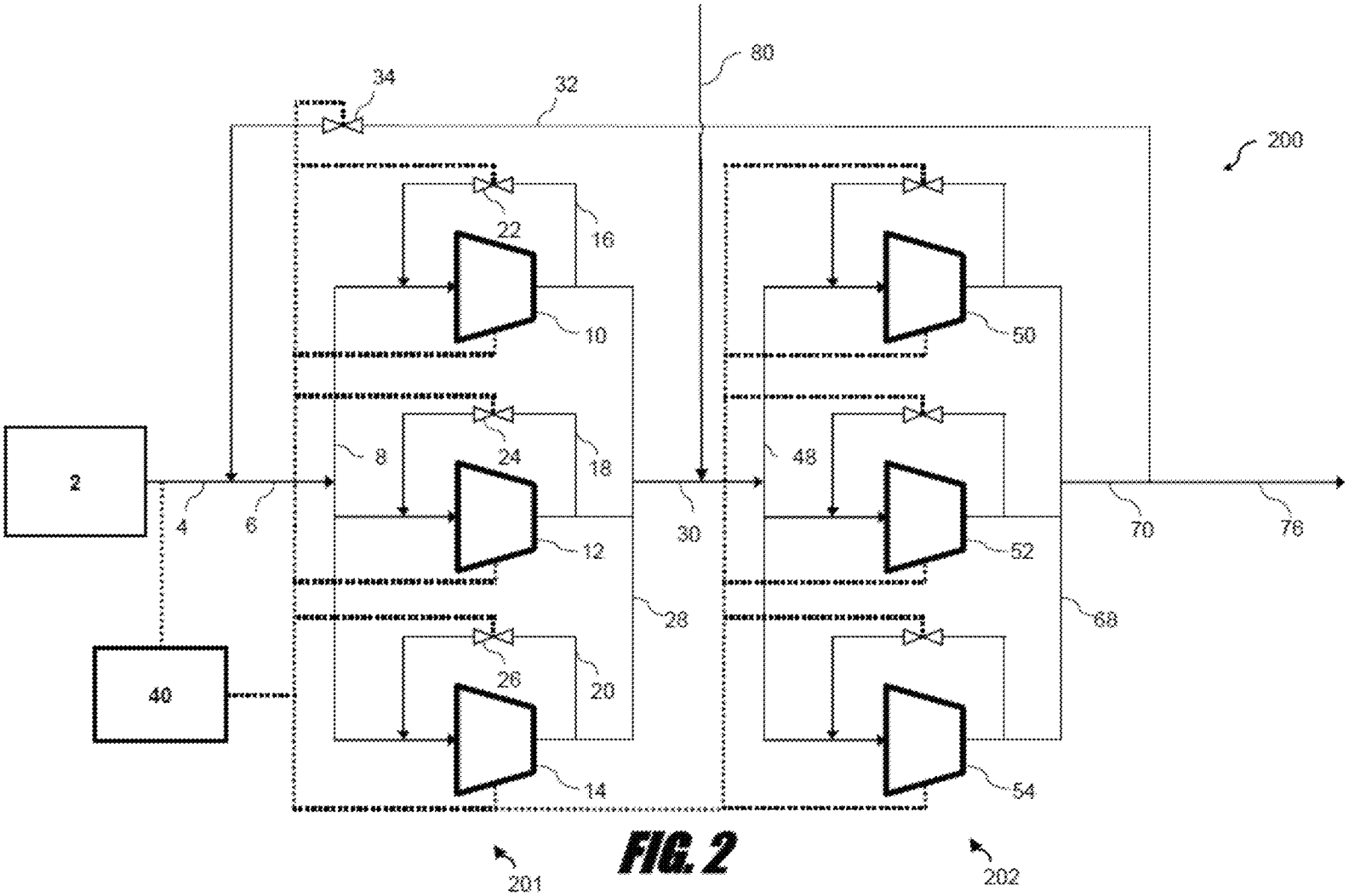
FIG. 2 is a simplified flowsheet for a second embodiment of the present invention.

FIG. 2 depicts a second embodiment of the present invention. The same numerical references have been used to denote features of the flowsheet in FIG. 2 that are common to the flowsheet of FIG. 1. The following is a discussion of the features that distinguish the first embodiment of FIG. 2 from the process shown in FIG. 1.

According to FIG. 2, the multistage compression system 200 has two stages of compression depicted, a first stage 201, and a second stage 202.

The compressed gas from header 28 forms combined stream 30 which is then fed to header 48 of the second stage 202. The second stage comprises the same features as the first stage 201 from FIG. 1, including three centrifugal compressors 50, 52, and 54 with the associated local recycle systems and valves.

In FIG. 2 the main recycle system recycles compressed gas from the outlet of the second stage (stream 70) and, after suitable pressure reduction using valve 34, feeds it to the inlet to the first stage as stream 6. Stream 76 contains net compressed gas and is fed to a downstream stage of compression (not shown) or at least one downstream process (not shown).

Stream 80 shows where the addition of compressed gas at an appropriate pressure from a suitable storage system may be added, e.g. when there is particularly low flow of gas from the electrolysers 2, and/or where demand from the downstream process (not shown) cannot be met by the electrolysers 2 alone. Stream 80 may add gas from storage by feeding it to an inter-stage point (stream 30) between stages 201 and 202.

Figure 3:
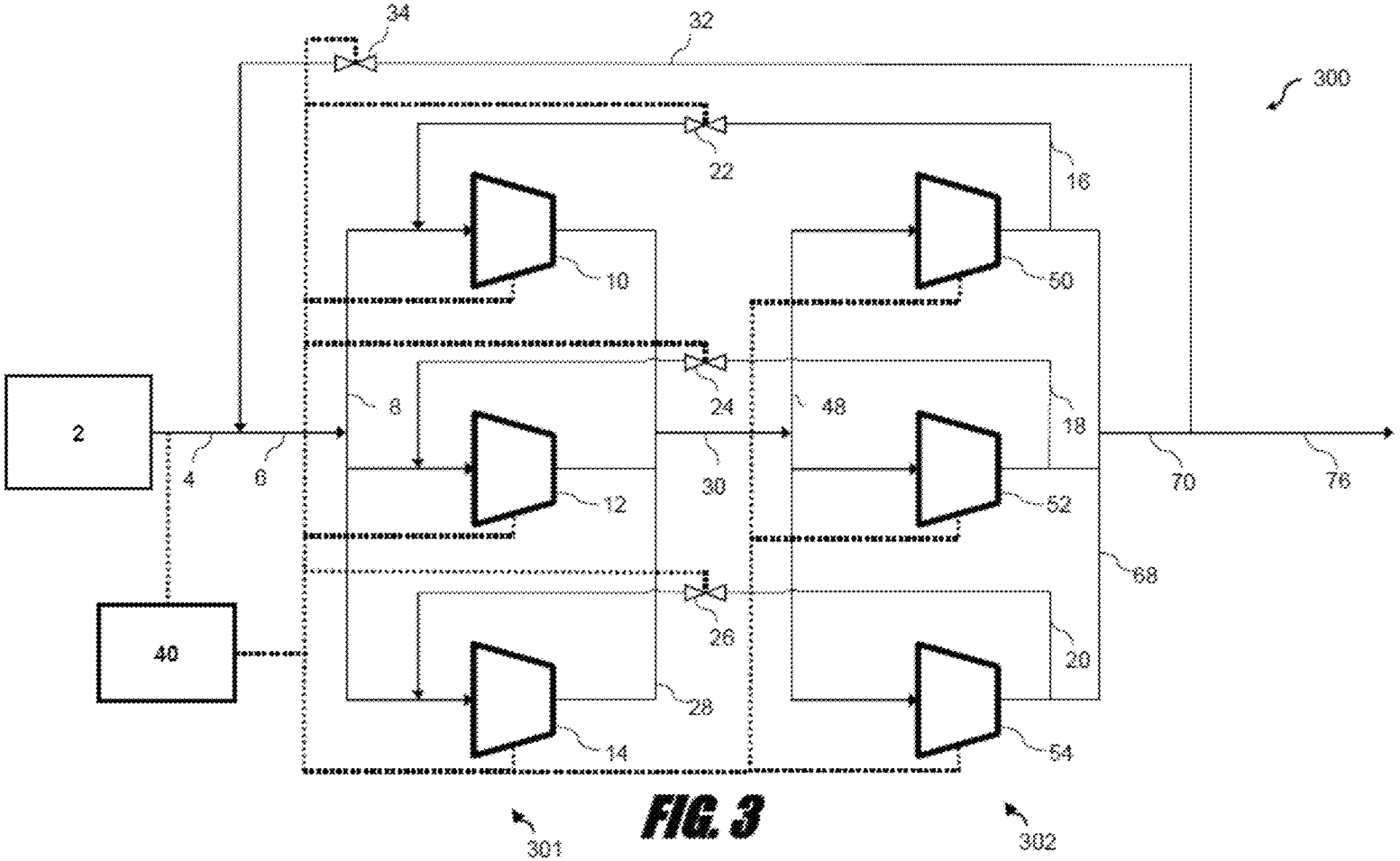
FIG. 3 is a simplified flowsheet for a third embodiment of the present invention.

FIG. 3 depicts a third embodiment of the present invention. The same numerical references have been used to denote features of the flowsheet in FIG. 3 that are common to the flowsheet of FIG. 2. The following is a discussion of the features that distinguish the first embodiment of FIG. 3 from the process shown in FIG. 2.

Regarding FIG. 3, a simplified design of the multistage compression system depicted in FIG. 2 is shown. In this figure, the multistage compression system 300 still comprises two stages, 301 and 302. However, the local recycle systems 16, 18, and 20 receive gas from the outlet of a compressor (50, 52, or 54) in the second stage 302 and, after suitable pressure reduction with valves (22, 24, or 26), feed reduced pressure gas to the inlet of a different, yet corresponding compressor in series within the first stage 301.

Thus, compared with the arrangement in FIG. 2, this arrangement has three less recycle systems and three less valves required. It therefore allows for a simpler, more cost effective design of the multistage compression system that is simpler to operate. However, note that no gas can be fed from storage to an interstage.

Figure 4:
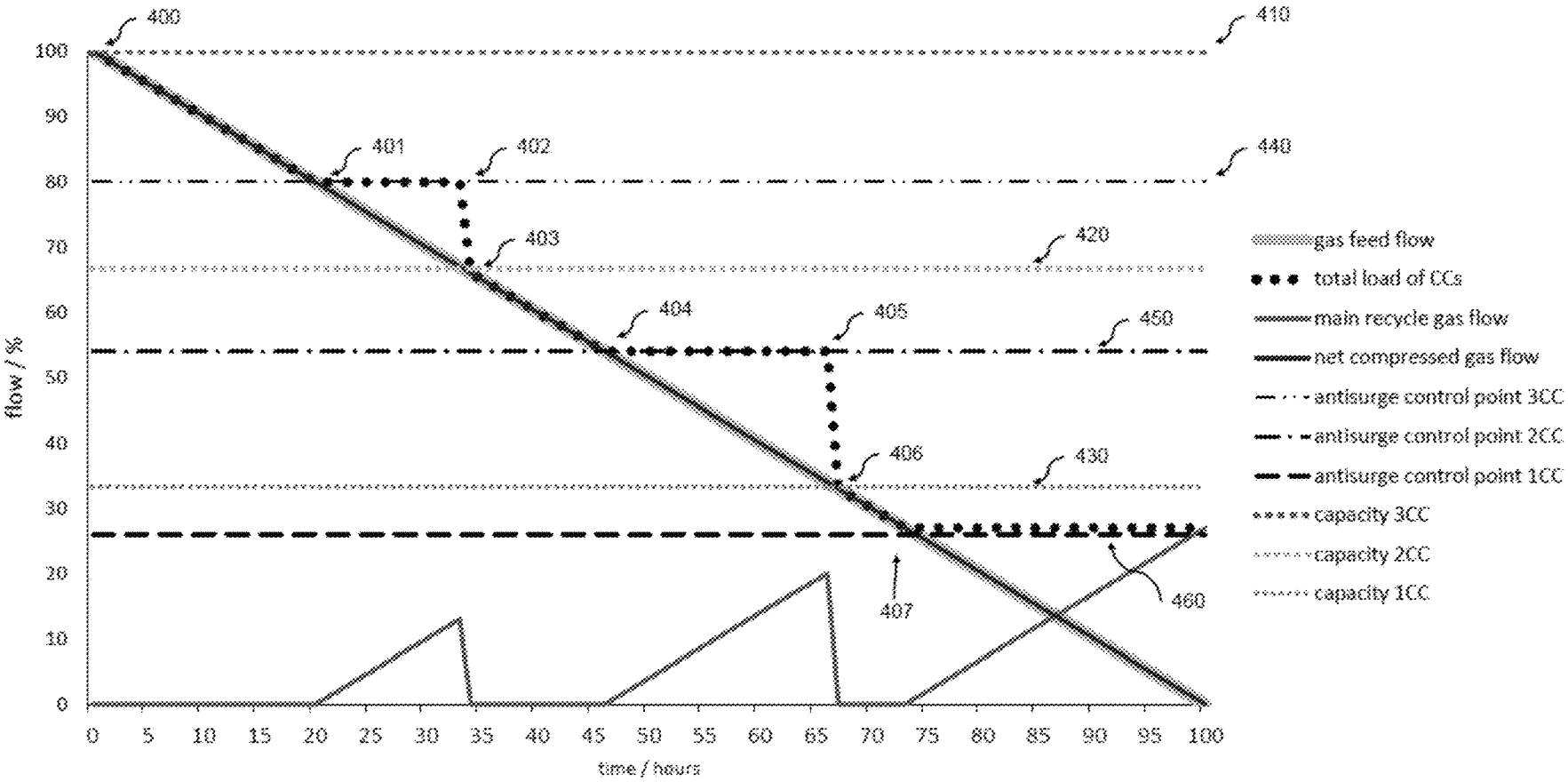
FIG. 4 is a line graph providing a illustrated simulated example of the process of the present invention in the context of three centrifugal compressors arranged in parallel.

FIG. 4 is a line graph which illustrates an example of how a multistage compression system such as the one depicted in FIG. 1, may be operated according to the process of the present invention. This data has been generated using Microsoft Excel and may not precisely reflect observation in a real world example.

In this example, there are three (N) centrifugal compressors each with a turndown capacity of 80%. For simplicity, this example assumes a linear decrease in flow of the gas feed starting from a flow of 100% over 100 hours at a rate of 1% per hour. This graph does not show any local recycle gas flow, or part of the unloading phase of the centrifugal compressors. In reality, flow of the gas feed would be expected to fluctuate widely over this time period rather than decrease steadily. However, the example is intended to merely illustrate the process.

At reference numeral 400 (0 hours), the gas feed flow is 100% of the capacity of all three (n) centrifugal compressors which are producing net compressed gas (shown with line 410). The first number (n) of centrifugal compressors is therefore 3. The gas feed flow is equal to the total maximum capacity of the three centrifugal compressors (100%) and so all three compressors are at full load (100%) compressing all of the gas feed. This corresponds to the periods specified in (a) according to the invention.

From 1 to 19 hours, as the flow of the gas feed reduces below 100% the three (n) centrifugal compressors are turned down accordingly to match the flow of the gas feed (from 1 to 20 hours). This corresponds to the periods specified in (b) according to the invention.

At reference numeral 401 (20 hours) the flow of the gas feed reaches the total maximum turndown capacity of the three compressors (80%, shown with line 440). That is, just above the point at which anti-surge control for all three centrifugal compressors is activated. In order to prevent anti-surge controls from activating, the main recycle system starts to introduce recycled gas through the (n) centrifugal compressors in order to maintain the load just above the point at which anti-surge control is activated. From 20 to 33 hours, the flow of the gas feed drops further below this point, and so the more recycled gas flow is introduced by the main recycle system to compensate. This corresponds to the periods specified in (c) according to the invention.

At reference numeral 402 (33 hours) the flow of the gas feed is equal to the total maximum capacity for a 2 centrifugal compressors, i.e. the second number (n−1), centrifugal compressors (66%, shown with line 420). Therefore, at this point one centrifugal compressor is unloaded and put into low power mode or shut down, whilst the remaining two centrifugal compressors are simultaneously loaded to maximum capacity (66% of total flow for two compressors, shown with line 420). At this point (at reference numeral 403), given the load for the two remaining compressors is now above the anti-surge control points for both compressors (54%) (shown as a line with reference numeral 450), there is no longer any need to recycle gas using the main recycle system.

At reference numeral 403 the amount of recycled gas drops to zero, which ideally would be the most efficient way to operate the system. However, it will be appreciated that in practice the change may be more gradual to prevent shocks to the flow of the system and to accommodate more gradual changes in load for centrifugal compressors.

The process then repeats as above, but for n=2 compressors, since now there are only two compressors in operation producing net compressed gas (with the other in low power or shutdown).

Between reference numerals 403 and 404 the gas feed flow allows for turndown of the two compressors without recycling. At 404, recycling is required to maintain the load of two (n) compressors above their anti-surge control points (shown with line 450). At reference numeral 405, the gas feed flow reaches the total maximum capacity for one compressor, since (n−1)=(2−1)=1. At this point one of the two compressors is unloaded and shut down or put in low power mode, and the last remaining compressor is operated at maximum load for one compressor (33%, shown with line 430) to compress the flow of the gas feed (33%).

From reference numeral 406 to 407 the final compressor can be turned down in line with the flow of the gas feed. At 407 however, the flow of the gas feed reaches just above the anti-surge control point (27%, shown with line 460) for the final (n) compressor and recycling is required by the main recycle system to ensure the load of the final (n) compressor is maintained above its anti-surge control point (27%), with more recycled gas being added the lower the gas feed flow drops.

FIG. 4 demonstrates how the multistage compression system of FIG. 1 can be operated in a way that it dynamically responds to the changes in gas feed flow, including sequentially shutting compressors down or putting them in a low power mode whilst simultaneously balancing the load of the remaining compressors with less (or no) recycling from the main recycle system.

It can be seen from FIG. 4 that the line for amount of flow of net compressed gas tracks the flow of the gas feed from the electrolysers, without requiring unnecessary recycling, shutting down all compressors, or unnecessarily wasting electricity. This demonstrates how the process of the invention is able to operate centrifugal compressors safely by maintaining their load just above the anti-surge control lines whilst still efficiently compressing a gas feed that has a variable flow ranging anywhere from 100% flow down to 0% flow.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

In this specification, unless expressly otherwise indicated, the word "or" is used in the sense of an operator that returns a true value when either or both of the stated conditions are met, as opposed to the operator "exclusive or" which requires only that one of the conditions is met. The word "comprising" is used in the sense of "including" rather than to mean "consisting of".

All prior teachings above are hereby incorporated herein by reference. No acknowledgement of any prior published document herein should be taken to be an admission or representation that the teaching thereof was common general knowledge in Australia or elsewhere at the date thereof.

The invention claimed is:

1. A process for operating a multistage compression system compressing a gas feed having a variable flow rate, said multistage compression system comprising a feed end, a plurality (N) of centrifugal compressors in parallel, a product end, and a main recycle system for recycling gas through the plurality (N) of centrifugal compressors, wherein each centrifugal compressor comprises an inlet, an outlet, and a local recycle system with anti-surge control for recycling gas from the outlet to the inlet, said process comprising:

(a) during periods when the gas feed is received by the multistage compression system at a flow equal to the total maximum capacity of a first number (n) of centrifugal compressors producing net compressed gas, operating said first number (n) of centrifugal compressors at full load for compressing the gas feed;

(b) during periods when the gas feed is received by the multistage compression system at a flow in a range from less than total maximum capacity of said first number (n) of centrifugal compressors to total turndown capacity of said first number (n) of centrifugal compressors, operating said first number (n) of centrifugal compressors at minimum load for compressing the gas feed, said minimum load being determined based on the flow of the gas feed;

(c) during periods when the gas feed is received by the multistage compression system at a flow in a range from less than total turndown capacity of the first number (n) of centrifugal compressors to more than total maximum capacity for a second number (n−1) of centrifugal compressors producing net compressed gas, recycling compressed gas using the main recycle system as required to maintain the load of said first number (n) of centrifugal compressors above the point at which the anti-surge controls are activated; and (d) during periods when the gas feed is received by the multistage compression system at a flow equal to the total maximum capacity for said second number (n−1) of centrifugal compressors, unloading a centrifugal compressor to put said compressor into a low power mode or shutdown mode in which said compressor produces no net compressed gas, while simultaneously loading the remaining centrifugal compressors to maximum capacity, wherein the process is reversible at any point, and wherein n is a whole number equal to or less than N.

2. The process according to claim 1, wherein the gas for compression is hydrogen gas.

3. The process according to claim 2, wherein the hydrogen gas is produced by electrolysis of water.

4. The process according to claim 1, wherein the gas for compression is produced at least in part using electricity generated from at least one renewable energy source.

5. The process according to claim 1, wherein during periods specified in (b) the turndown capacity of each centrifugal compressor is defined as the minimum flow of gas that can be compressed by the centrifugal compressor without activation of its anti-surge control.

6. The process according to claim 1, wherein during periods specified in (b) the turndown capacity of each centrifugal compressor is from 60% or more of maximum gas flow through the centrifugal compressor.

7. The process according to claim 1, wherein during periods specified in (b) the flow of the gas feed is distributed uniformly across all (n) centrifugal compressors at minimum load.

8. The process according to claim 1, wherein during periods specified in (c) the amount of recycling of compressed gas is maintained at a minimum amount to conserve electricity.

9. The process according to claim 1, wherein during periods specified in (d) the unloading of the centrifugal compressor comprises first reducing the flow of net compressed gas through said centrifugal compressor to zero using the local recycle system, and second reducing the load of said centrifugal compressor.

10. The process according to claim 1, wherein putting a centrifugal compressor in low power mode comprises reducing the rotor speed of the centrifugal compressor to a speed that is still sufficient to prevent contact of opposed seal faces of a dry gas seal within the centrifugal compressor.

11. The process according to claim 1, wherein unloading to put a centrifugal compressor in said low power mode comprises reducing its rotor speed to within a range of from about 100 rpm to about 1500 rpm and operating such that it produces no net compressed gas.

12. The process according to claim 1, wherein during operation in said low power mode the centrifugal compressor is operating with a power of about 20% or less relative to maximum power and producing no net compressed gas.

13. A process for supplying compressed hydrogen gas for consumption in at least one downstream process, comprising:

producing said hydrogen gas from electrolysis of water, compressing said hydrogen gas in a multistage compression system operated according to claim 1, and feeding said compressed hydrogen gas to at least one downstream process for consumption in said downstream process(es).

14. The process according to claim 13, wherein at least some of the compressed hydrogen gas is used to produce ammonia and/or methanol in the downstream process(es).

15. An apparatus for operating a multistage compression system compressing a gas feed having a variable flow rate according to claim 1, said apparatus comprising:

a multistage compression system comprising a feed end, a plurality (N) of centrifugal compressors in parallel, a product end, and a main recycle system for recycling gas through the plurality (N) of centrifugal compressors, wherein each centrifugal compressor comprises an inlet, an outlet, and a local recycle system with anti-surge control that recycles gas from the outlet to the inlet;

a control system for controlling the load of each centrifugal compressor and for controlling the amount of recycling by the main recycle system and local recycle system, as required, based on the flow of the feed gas.

16. The apparatus according to claim 15, comprising:

an electricity generation system for generating electricity from at least one renewable energy source, and wherein the gas for compression is produced at least in part using electricity generated from said electricity generation system.

17. The apparatus according to claim 15, wherein the gas for compression is hydrogen gas, the apparatus comprising:

a plurality of electrolysers for producing said hydrogen gas, wherein the electrolysers are powered at least in part by electricity generated from said electricity generation system, and wherein said feed end of said multistage compression system is in fluid flow communication with said plurality of electrolysers.

18. The apparatus according to claim 15, comprising at least one downstream processing unit for consuming compressed gas, said downstream processing unit(s) being in fluid flow communication with said outlet end of said multistage compression system.

19. The apparatus according to claim 15, comprising:

a storage system for storing compressed gas, said storage system being in fluid flow communication with said outlet end of said multistage compression system and at least one compressor of said multistage compression system; and a second control system for controlling pressure and flow of compressed gas from said multistage compression system to said storage system and for controlling pressure and flow of compressed gas from said storage system to said compressor(s) of said multistage compression system based on the flow of the gas feed to the multistage compression system.

* * * * *